US008177616B2

(12) United States Patent
Nicely

(10) Patent No.: US 8,177,616 B2
(45) Date of Patent: May 15, 2012

(54) GAMING SYSTEM AND METHOD FOR PROVIDING MULTIPLE HAND THREE-CARD POKER GAME

(75) Inventor: Mark C. Nicely, Daly City, NV (US)

(73) Assignee: IGT, Reno, NV (US)

( * ) Notice: Subject to any disclaimer, the term of this patent is extended or adjusted under 35 U.S.C. 154(b) by 1225 days.

(21) Appl. No.: 11/935,847

(22) Filed: Nov. 6, 2007

(65) Prior Publication Data

US 2009/0117959 A1 May 7, 2009

(51) Int. Cl.
*A63F 9/24* (2006.01)

(52) U.S. Cl. ..... 463/13; 463/20; 463/25; 463/30

(58) Field of Classification Search ..... 463/13, 463/20, 25, 30
See application file for complete search history.

(56) References Cited

U.S. PATENT DOCUMENTS

| | | | | |
|---|---|---|---|---|
| 5,636,842 | A | 6/1997 | Cabot et al. | |
| 6,007,424 | A | 12/1999 | Evers et al. | |
| 6,062,979 | A | 5/2000 | Inoue | |
| 6,155,568 | A | 12/2000 | Franklin | |
| 6,457,715 | B1 | 10/2002 | Friedman | |
| 6,474,646 | B1 | 11/2002 | Webb | |
| 6,491,302 | B1 | 12/2002 | Boylan et al. | |
| 6,811,153 | B1 | 11/2004 | Ko | |
| 6,986,514 | B2 | 1/2006 | Snow | |
| 7,195,244 | B1 | 3/2007 | Feola | |
| 2003/0006555 | A1 | 1/2003 | Boylan et al. | |
| 2003/0114209 | A1 | 6/2003 | Ritner et al. | |
| 2005/0170875 | A1 | 8/2005 | Snow | |
| 2006/0084505 | A1 | 4/2006 | Yoseloff et al. | |
| 2007/0035091 | A1 | 2/2007 | Tang | |
| 2007/0066376 | A1 * | 3/2007 | Webb | 463/13 |
| 2007/0170652 | A1 * | 7/2007 | Perrie et al. | 273/292 |
| 2007/0205559 | A1 * | 9/2007 | Webb et al. | 273/292 |
| 2007/0262527 | A1 * | 11/2007 | Moss | 273/292 |
| 2007/0284822 | A1 * | 12/2007 | Banh | 273/292 |
| 2008/0090630 | A1 * | 4/2008 | Yoshizawa | 463/13 |
| 2008/0108412 | A1 * | 5/2008 | Snow et al. | 463/20 |

* cited by examiner

*Primary Examiner* — Dmitry Suhol
*Assistant Examiner* — Brandon Gray
(74) *Attorney, Agent, or Firm* — K&L Gates LLP

(57) ABSTRACT

A gaming system having a multiple hand Three-card Poker game is provided. The Three-card Poker game includes seven cards dealt to the player and the dealer. First the gaming system sets the seven dealer cards to form a high three-card dealer hand, a low three-card dealer hand, and a tie breaker card, according to a set of predetermined rules. Similarly, the player sets the seven player cards to form a high three-card player hand, a low three-card player hand, and a tie breaker card. For the player and dealer hands, the high three-card hand must have a rank greater than or equal to the rank of the low three-card hand, and the rank of the low three-card hand must be greater than or equal to the tie breaker card. If the high and low three-card player hands both beat the corresponding dealer hands, the player wins an award. If only one of the three-card player hands beats the corresponding dealer hand, the outcome of the game is determined by the tie breaker card.

25 Claims, 31 Drawing Sheets

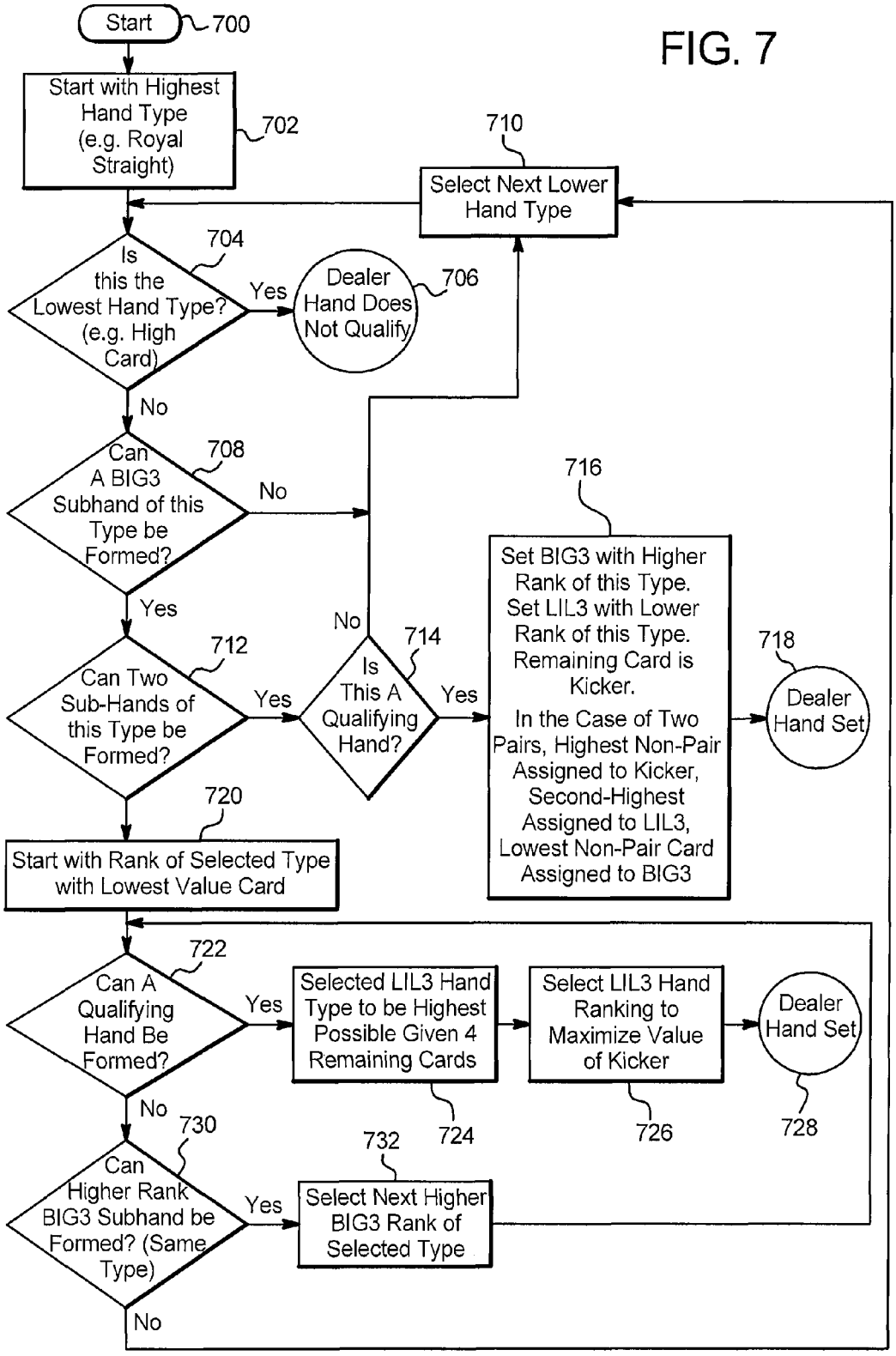
FIG. 7
Start
700
Start with Highest Hand Type (e.g. Royal Straight)
702
710
Select Next Lower Hand Type
704
Is this the Lowest Hand Type? (e.g. High Card)
Yes
Dealer Hand Does Not Qualify
706
No
708
Can A BIG3 Subhand of this Type be Formed?
No
716
Set BIG3 with Higher Rank of this Type. Set LIL3 with Lower Rank of this Type. Remaining Card is Kicker.
In the Case of Two Pairs, Highest Non-Pair Assigned to Kicker, Second-Highest Assigned to LIL3, Lowest Non-Pair Card Assigned to BIG3
718
Dealer Hand Set
Yes
712
Can Two Sub-Hands of this Type be Formed?
Yes
No
714
Is This A Qualifying Hand?
Yes
720
Start with Rank of Selected Type with Lowest Value Card
722
Can A Qualifying Hand Be Formed?
Yes
Selected LIL3 Hand Type to be Highest Possible Given 4 Remaining Cards
724
Select LIL3 Hand Ranking to Maximize Value of Kicker
726
Dealer Hand Set
728
No
730
Can Higher Rank BIG3 Subhand be Formed? (Same Type)
Yes
732
Select Next Higher BIG3 Rank of Selected Type
No

GAMING SYSTEM AND METHOD FOR PROVIDING MULTIPLE HAND THREE-CARD POKER GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. Numerous variations of poker exist, including Five Card Draw, Three-card Poker, Five Card Stud, Seven Card Stud, Hold'em (also called Texas Hold'em), Omaha (also called Omaha Hold'em), and Pai-Gow Poker. The variations in these games generally differ in the manner in which cards are dealt and in the manner and frequency in which bets are placed. Various criteria may also be used to determine the winning hand, including highest ranking hand, lowest ranking hand (Low-Ball), and where the high and low hands each win half of the pot (High-Low).

The number of cards dealt depends on the particular variation of poker being played. For example, in Five Card Draw Poker, the player gets five cards dealt face up from a 52 card deck of playing cards. The player can discard none, one, a plurality or all of the five cards. Each discarded card is replaced with another card from the deck. After the replacement, the cards are evaluated for winning combinations. For a five card poker game, there are ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣ K♣ Q♣ J♣ 10♣ |
| 2 | Straight Flush | K♣ Q♣ J♣ 10♣ 9♣ |
| 3 | Four of a Kind | J♣ J♥ J♦ J♠ 3♣ |
| 4 | Full House | A♥ A♦ A♣ 6♦ 6♣ |
| 5 | Flush | A♣ J♣ 8♣ 6♣ 2♣ |
| 6 | Straight | 8♦ 7♣ 6♠ 5♠ 4♣ |
| 7 | Three of a Kind | Q♣ Q♥ Q♦ 6♦ 2♣ |
| 8 | Two Pair | 8♦ 8♥ 5♥ 5♣ 2♠ |
| 9 | One Pair | K♦ K♣ 8♣ 7♣ 2♥ |
| 10 | High Card | A♥ 10♣ 7♦ 5♣ 3♣ |

Within each category, hands are ranked according to the rank of individual cards, with an Ace being the highest card and a two being the lowest card. There is no difference in rank between the four suits of cards. All hands can be ranked in a linear ranking from highest to lowest. Because suits are all of the same value, however, there are multiple hands that have identical rankings.

In typical Three-card Poker games, the player plays against a dealer hand. The player is dealt a total of three-cards to form a player hand. The dealer hand also includes a total of three-cards. In certain known Three-card Poker games, the initially dealt player hand and dealer hand are final and there is no option to replace or draw any new cards. Certain variations of Three-card Poker include one or more side-games. One side-game is commonly referred to as the Pair Plus game. In this side game, the player wages on whether or not the player will be dealt a pair or better. Certain gaming establishments allow wagering on either of the games and other gaming establishments require a player to make an Ante Bet on the base game in order to participate in the Pair Plus portion of the game.

In one common multiplayer version of Three-card Poker, there are three wagering areas at each player position on a gaming table. One wagering area labeled Pair Plus is where the player puts a wager on the Pair Plus game. For the base game, there are two wagering areas labeled Ante and Play. The game starts with a player placing a wager in the Pair Plus and/or Ante circle. After all the players have placed their wagers, the dealer deals three-cards face-up to each player. In general, if a player has wagered an Ante, they must make a decision to fold or continue playing after looking at their hand. If the player folds, the Ante wager is forfeited without the player having ever determined if his/her hand would have beaten the dealer's hand. If a player wishes to continue, the player is required to place an additional wager (in the Play wagering area) equal to their Ante bet. For example, if a player wagered five credits on the Ante bet, the Play wager would also need to be five credits. Accordingly, the player can make a relatively small initial wager to see their cards and determine if they want to continue with the game.

After all the players have determined whether to forfeit or continue playing, the dealer reveals his/her three-card hand. According to certain Three-card Poker rules, the dealer must qualify with a hand of rank of at least Queen or better for play to continue. If the dealer's hand rank is lower than a Queen high, all active players are paid even money for their Ante wager even if their hand is a lower hand than the dealer hand. Also, the Play wager is returned to the player. If the dealer's hand qualifies, then the dealer's hand is compared to the player's hand. If the player's hand outranks the dealer's hand, the player is paid even money for both the Ante wager and the Play wager. If the dealer's hand beats the player's hand, the player loses both wagers. If the rank of the player's hand is the same as the dealer's hand the player wins the wager or pushes depending on the house rules.

The hand rankings for Three-card Poker are different than the hand rankings for Five Card Poker, as listed in Table 1 above. This is because the mathematical probabilities of making certain hands are different for Three-card Poker and because there are less cards in a given hand (e.g., a player cannot achieve two-pair when there is only three-cards in a hand). The Three-card Poker hands are generally ranked from the highest to the lowest as shown in Table 2 below.

TABLE 2

Ranking of Three-card Poker Hands by Category

| Rank | Name | Example |
|---|---|---|
| 1 | Royal Straight Flush | A♣ K♣ Q♣ |
| 2 | Straight Flush | K♣ Q♣ J♣ |
| 3 | Three of a Kind | Q♠ Q♥ Q♦ |
| 4 | Straight | 8♦ 7♣ 6♠ |
| 5 | Flush | A♣ J♣ 8♣ |
| 6 | One Pair | K♦ K♠ 8♣ |
| 7 | High Card | A♥ 10♣ 7♦ |

The Pair Plus wager is based only on whether a player's three-card hand has a pair or higher. The Pair Plus wager is paid based on a pay table established by the gaming establishment. Therefore, even if the player loses to the dealer, if the player has a hand rank of at least a pair, the player wins the Pair Plus Wager. Accordingly, the Pair Plus wager can be used to hedge against a frustrating loss to the dealer where the player has a good hand. An example pay table for the Pair Plus wager is listed in Table 3 below.

TABLE 3

Example Paytable for Pair Plus Hands

| Hand Type | Payout |
|---|---|
| Straight Flush | 40-1 |
| Three of a Kind | 30-1 |
| Straight | 6-1 |
| Flush | 4-1 |
| Pair | 1-1 |

Other variations of Three-card Poker have a bonus payout relative to a player's Ante bet based on the player's hand if the player has a high enough ranking hand without regard to whether the player beat the dealer. For example, whether or not a player placed a Pair Plus wager, if the player placed an Ante wager, and the player achieved a very high ranking hand such as a Straight Flush or Three of a Kind, the gaming system provides the player with a bonus payout relative to the Ante wager.

The poker variation of Three-card Poker has become a quite popular casino table game. Three-card Poker is relatively easy for a player to learn, and does not take much additional player effort to learn the strategies which optimize average expected player payback. However, the lack of interesting decision making and player interaction can make this game tiresome to play for certain more experienced players.

Other casino card games, such as Pai Gow Poker, include player interaction and decision making elements where a player can set the cards in one or more player hands. In one common variation of Pai Gow poker, the player can form two poker hands out of seven dealt cards. The two hands must be formed into a five-card poker hand and a two-card poker hand, where the five-card hand must rank higher than the two-card hand. In order for a player to win a round of play in Pai Gow Poker, the player's five card hand must rank higher than the dealer's five card hand and the player's two card hand must rank higher than the dealer's two card hand. If the player wins, a 5% commission or "vig" is deducted from the player's winnings. For example, a player who placed a $10 wager and wins, receives $9.50 for their win award in addition to having their wager returned. This corresponds to a $10.00 win minus a 5% vig of $0.50, yielding a $9.50 total award. Many players dislike this pay mechanism. Similarly, this discourages players from making off sized wagers, such as betting $12.00, because of the difficulty for the casino dealer to pay out awards with the small change required to make the correct pays. In Pai Gow Poker, there are a high percentage of rounds of play that result in the player tying or pushing with the dealer. The high number of ties can be tedious for certain players. In Pai Gow Poker, a 53 card deck is used which includes one joker card. Unlike the most poker games where the joker takes on the value of any other card to optimize a hand, Pa, Gow has special rules that allow a joker to complete a flush or a straight, otherwise the joker is evaluated as an Ace. Another Pai Gow Poker variation relative to most poker games, is in the evaluation of the hand with the values A-2-3-4-5, In standard poker, a hand with 2-3-4-5-6 (of different suits) would be evaluated as ranking higher than the hand A-2-3-4-5 (of non-matching suits). In Pai Gow Poker, A-2-3-4-5 is considered the $2^{nd}$ highest ranked straight, higher than 9-10-J-Q-K and just lower than the highest ranked straight, 10-J-Q-K-A. These rule differences from standard poker make Pai Cow Poker confusing for some players and therefore harder for novices to learn the game.

There is a need to increase the level of interest, excitement and intrigue associated with other types of card games. There is also a need to provide improvements to, and interesting variations of, card-related games such as Three-card Poker. Needs therefore exists for new and exciting poker games with high degrees of player interaction, including a need for new Three-card Poker Games.

SUMMARY

Various embodiments of the present disclosure relate to a gaming system providing a multiple hand Three-card Poker game, and methods of playing and operating a multiple hand Three-card Poker game at a gaming table or through a gaming device. In these embodiments, the gaming system causes several cards to be dealt to the player, and the player is able to set the multiple three-card player hands by selecting which of the cards should be placed in, moved to, or associated with each particular player hand. Similarly, the gaming device deals several dealer cards and forms a plurality of three-card dealer hands according to a predetermined set of rules.

In one embodiment, the gaming system includes player hand setting rules that require at least one of the three-card player hands to have a rank greater than another one of the three-card player hands. In this embodiment, the gaming system also includes dealer hand setting rules for forming the multiple three-card dealer hands. In a play of various embodiments of the game, the formed higher ranking player hand competes against a corresponding higher ranking dealer hand, and the formed lower ranking player hand competes against the lower ranking dealer hand.

In certain embodiments where the Three-card Poker game includes two three-card player hands competing against two three-card dealer hands, in the event that the player wins one hand and loses one hand, the gaming system includes one or more tie breaking events, as discussed below. Therefore, these embodiments provide a multiple hand Three-card Poker game, where the player is allowed to strategically set the cards in the different player hands.

In one embodiment, the Three-card Poker game includes two three-card player hands, two corresponding three-card dealer hands, and also includes a player tie breaker card and a corresponding dealer tie breaker card. Therefore, in one embodiment, the player has a total of three hands: (a) a first three-card poker hand; (b) a second three-card poker hand; and (c) a tie breaker hand consisting of a single card, it should be appreciated that in other embodiments, the tie-breaker hand includes more than one card. Therefore, in a play of the game, the gaming system deals a total of seven player cards to the player and deals a total of seven dealer cards. In one embodiment, the gaming system initially deals the seven player cards, visible to the player, in a player card area, and deals seven dealer cards face-down in a dealer card area. The gaming system enables the player to designate three of the seven player cards to form the high three-card player hand, designate three of the seven player cards to form the low three-card player hand, and designate one player card as the tie breaker hand. After the player has completed the setting of the player hand, the gaming system reveals the dealer cards and separates the seven dealer cards into a high three-card dealer hand, a low three-card dealer hand, and a tie breaker dealer hand, according to a set of predetermined rules. In one embodiment, the predetermined rules for the gaming system to set the dealer hands does not use any information about the players hands. In another embodiment, information about the cards in the player's hands is used to by the gaming system to set the dealer hands. As shown above in Table 2, Three-card Poker games generally include seven general rankings that rank, from highest to lowest as follows: Royal Straight Flush; Straight Flush; Three of a Kind; Straight Flush; One Pair; and High Card. In this embodiment, the rank of the high-three-card hand for the high three-card player and dealer hands must be greater than or equal to the rank of the respective low three-card player hand and low three-card dealer hand. In addition, the rank of the low three-cards player and dealer hands must be greater than or equal to the rank of the respective tie breaker hand. Because the tie breaker hand includes only one cards the low three-card hand must either: (a) have at least one card that is higher than the tie breaker card; or (b) have a rank of One Pair or higher. A setting of cards which is not set according to these rules is generally known as a foul hand. In one embodiment, the gaming system will not allow the player the player to create a play a foul hand. Rather, the gaming system will inform the player about the foul hand and allow or require the player to reset the player hands to conform with the rules, such that the card setting no longer results in a foul hand. In another embodiment, especially in the case where the gaming system is a table game with a human dealer, the player's hand setting is not revealed to the dealer until after the dealer cards have been seen by the player. If the player has a foul hands the player is not permitted to reset the player hand. In this embodiment, the player automatically loses that game. This embodiment is similar or identical to how foul hands are treated in Pai Cow Poker games dealt by live dealers in certain gaming establishments. In another embodiment, the player is able to request that the gaming system reset the cards in the player hands based on predetermined rules.

In one embodiment, the gaming system sets the dealer cards prior to allowing the player to set the player cards. In one variation of said embodiment, the dealer cards remain face-down until the player has set the player's hands. In another variation of the embodiment, the dealer cards are revealed to the player when the gaming system sets the dealer cards and prior to allowing the player to set the players hands. In one embodiment, the gaming system reveals a number of dealer cards less than the total number of dealer cards to the player prior to the player setting the player card hands.

In one embodiment, the Three-card Poker game includes the ability to set two three-card player hands and two corresponding three-card dealer hands, but does not include the ability to set a seventh tie breaker card. Therefore, the player has a total of two hands: (a) a first three-card poker hand; and (b) a second three-card poker hand. Therefore, in a play of the game, the gaming system deals a total of six player cards to the player and deals a total of six dealer cards. In one embodiment, the gaming system initially deals the six player cards in the player card area such that the cards are visible to the player, and deals six dealer cards face-down in a dealer card area. The gaming system enables the player to view the six player cards and set the two player hands. That is, the gaming system enables the player to designate three of the six cards to form the high three-card player hand, designate the remaining three-cards to form the low three-card player hand. The gaming system separates the six dealer cards into a high three-card dealer hand and a low three-card dealer hand, according to a set of predetermined rules In this embodiment, if the player and dealer each win one of the hands (e.g., the player wins the high three-card hand and the dealer wins the low three-card hand), the gaming system initiates a tie breaking event. In one embodiment, the tie breaking event includes randomly selecting and dealing a single player card and a single dealer card to determine an ultimate winner based on who has the high card. If said tie breaker cards are of equal ranking, then the dealer wins. In another embodiment, the winner in said tie condition is selected based upon the relative ranking of the best five card hand available from all six player hands and all six dealer hands. In one embodiment, the gaming system deals seven player cards and seven dealer cards which are set into a high and low three-card player and dealer hands as discussed above. In this embodiment, the seventh player card and dealer card are not used as a tie breaking hand as discussed in certain of the embodiments above. Rather, in this embodiment, the gaming system determines the best five-card poker hand from the seven total player cards and determines the best five-card poker hand from the seven total dealer cards. The highest ranking five-card player or dealer hand is used to break a tie in a round of play of the game. In one embodiment the tie breaking event is dealing an additional card to the player. In this embodiment, if the card is a six or less, the player wins. If the card is greater than a six, the player loses. It should be appreciated that the single card deal tie breaking even could be determined if the player has a sufficiently high card and may have any suitable high or low card threshold to achieve a particular house advantage. In one embodiment, the tie breaking event is a secondary event such as a tossing one or more actual or virtual die. In this embodiment, the player or dealer with the highest dice value wins the tie breaking event. In another embodiment, there is no tie break event or mechanism. In this embodiment, where one player hand outranks the corresponding dealer hand, and the other player hand does not outrank the corresponding dealer hand, the players wager is returned.

Certain embodiments feature a multi-stage wagering structure. In one embodiment, the player makes an initial wager, which is referred to as an Ante wager, to initiate play. After the gaming system deals the player a number of cards, the player is required to place an additional wager, which is referred to as a Play wager, in order for the player to continue in the game. Based on the rules of the game, the Play wager is required to be of a certain size relative to the size of the Ante wager. In one embodiment, the Play wager must be exactly equal to the Ante wager. If the player declines to make the required Play wager, the player forfeits his/her Ante wager and the round of play of the game ends. If the player makes the required Play wager, then the round of play of the game continues as described above.

In certain embodiments, the dealer hands must meet some qualification threshold in order for the player versus dealer hand comparison and payout to proceed in normal fashion. In one embodiment, the dealer hands qualify if the low three-card dealer hand is a rank of King high or higher. In another embodiment, the dealer hands qualify if the low three-card dealer hand is a rank of Ace high or higher. In one embodiment, the dealer hands qualify if the low three-card dealer hand is a rank of One Pair or better. In another embodiment, the dealer hands qualify if the high three-card dealer hand is of a certain defined rank or better. However, it should be appreciated that any other suitable dealer hand qualification method can be applied.

In one embodiment, if the dealer hands do not qualify, the player is paid 1:1 on the players Ante wager, and the players Ante wager and Play wager are returned to the player, regardless of the ranking of the player hands. In another embodiment, if the dealer hands do not qualify and the player hands do not outrank the required number of corresponding dealer hands per the rules of the game, the prayer forfeits the player's Ante wager and Play wager. However, if the required number of player hands do outrank the required number of dealer hands, the player is paid 1:1 on the player's Ante wager, and the gaming system returns the player's Ante wager and Play wager.

In certain embodiments, in addition to the required primary wager, the player can also place an optional secondary wager. In one embodiment, a multiple hand Three-card Draw Poker game is provided that allows a player to place the optional secondary wager and win a bonus prize if the highest ranking hand of the dealer's three-card hands and the players three-card hands corresponds to hand types listed in a bonus pay table. Therefore, the player can win a large award, even if losing to the dealer in the primary game. In another embodiment, an optional secondary wager with pay the player if one of the player's three-card hands corresponds to a hand type listed in a bonus pay table. In another embodiment, an optional secondary wager will pay the player based upon some defined combination of player and/or dealer cards. For example, the best five card hand based upon the six cards in the high three-card player hand and the low three-card player hand, relative to a bonus pay table. In another embodiment, the provided secondary wager is required to be equal to some defined proportion of the main game wager. Any suitable wagering restrictions can be employed such that the secondary wager is at least as large as the main game wager.

In one embodiment, after accepting the primary wagers the gaming device prompts the player to place an optional wager. Where the game is played at a video-based gaming console, the player inputs any primary and secondary wager by selecting an appropriate input device. The gaming device updates the players credits and indicates on a display device that the secondary wager has been placed. In various embodiments. The secondary wager is required to be greater than, equal to, or less than the primary wager. In one embodiment, the player must make the primary wager to be able to place the secondary wager. In another embodiment, the primary and secondary wagers must both be placed and be of equal size. When such a game is played at a video-based gaming console, the interface can enable the player to specify a bet to be simultaneously placed on both the primary and secondary wagers.

In one embodiment, a secondary wager award is provided to the player if the highest ranking hand of either of the player's three-card hands is one of a plurality of predetermined hand ranks. This award is based on a pay table and the pay table is typically constructed to pay larger awards for harder-to-achieve hands. It should also be appreciated that the gaming device could employ one or more progressive awards or other suitable awards for the winning secondary game.

Thus, the optional secondary wager enables each player to participate in two different wagers simultaneously, thereby enhancing the gaming experience. In certain embodiments, if the player achieves a high ranking hand, the player can win both the primary award and the secondary award.

Embodiments of the multiple hand Three-card Poker game may be provided by or played at a single gaming machine, a multiplayer gaming station or electronic table, each of a plurality of single gaming machines linked through a network to a progressive jackpot, or at a live gaming table with a human dealer. Although the game is particularly suited for a single player playing against a single dealer, it should be appreciated that the Three-card Poker game may be a multiplayer game, such as at a live gaming table, as mentioned above. Other embodiments may be played remotely from the gaming establishment, such as games played on a personal computer, personal digital assistant (PDA), mobile gaming device, or cellular phone. In these embodiments, a program is installed by the player or by someone else on the computer or other digital device to allow the player to play the game remotely. Alternatively, the program does not need to be explicitly loaded onto the player device but could be available by standard browser or thin-client technology by connecting through the Internet or other data network by accessing one or more servers of the gaming system.

In a multiplayer game where the hands are dealt from a single deck of playing cards, typically all of the cards are dealt face-down to both the player and the dealer. Accordingly, none of the players are able to obtain an advantage over the other players by being able to view the other players' cards. In certain circumstances, in accordance with the dealer rules, the dealer may have additional information about the cards already dealt. For example, in a game having card tracking devices, the values of all of the dealt cards may be stored into a memory device connected to the gaming table. In this embodiment, a processor aides the dealer in being able to choose cards to use in the high and low three-card dealer hands. In another embodiment, two or more decks of cards may be used.

When offered as a cash gambling game for profit, casino games need to have some mechanisms to assure that the game on average makes a profit for the casino in the long term. Some variations of the Three-card Poker game would lead to what is known as a "break-even" game on average, wherein there is no advantage to casino or player. Certain casinos avoid such offerings. Different embodiments of Three-card Poker relying upon different mechanisms for providing long-term casino profit can be employed to resolve these issues. In one embodiment, where there are only the two three-card hands, the casino will always win ties against the player. In one embodiment, a required secondary side bet of a specified size relative to the main game bet would provide the required long-term casino profit. Specifically, if the main game were a break-even proposition for the player, such as under the circumstances of the player and dealer operating under the same rules, long-term profit designed into the secondary wager can assure that the combined primary and secondary proposition is likewise profitable for the casino. In another embodiment, the casino takes a commission (also known as a vig or vigorish) on all player wins, as is done in the card game Pai Gow Poker. In another embodiment, tong-term profit can come from a multi-stage bet structure similar the Ante and Play bets used in Three Card Poker. In another embodiment, where only one player plays against a given dealer, the casino can obtain a long-term advantage by using actual player hand setting information to when setting the dealer hands.

Relative to the strength of the mechanism(s) selected for a given game definition to assure long-term casino profitability, advantageous-to-player rules may also be offered in order to somewhat counteract, though not eliminate, the casino profit advantage. Such advantageous-to-player rules include, but are not limited to, allowing the player to see some or all of the initial dealer cards before setting the cards in the high and low three-card player hands, allowing the player to see one or more cards in one or more of the final three-card dealer hands, etc.

In various embodiments, the deck of cards may include jokers, wild cards, modifier cards, and the game may include other suitable ways to modify the cards in the player hand and the dealer hand.

In one embodiment, the Three-card Poker game is played at a live gaming table with a human dealer. The gaming table can accommodate at least one player, and preferably can accommodate a plurality of players. In one such embodiment, the Three-card Poker game is played with one or more conventional decks of 52 playing cards. Prior to the start of the game, each player makes a wager on the primary game and places the wager in a primary wagering area on the table. At the same time, each player has the option of making a separate secondary wager. The separate additional wager is placed on the gaming table in a secondary wagering area on the table. This optional secondary wager functions in the same manner as where the Three-card Poker game is played at a video based gaming device or console as described above. The dealer set the cards in for the dealer hands according to a set of predetermined rules. Then the player is allowed to set the cards in the player hands. The dealer determines wins and losses for the primary game and provides each player at the table with any payouts or collects each prayers wagers in the event of a loss in the primary game in a conventional manner.

In another table based multiple hand Three-card Poker embodiment, the player hands are all dealt face-down such that players at the table are not able to see the cards of the other players. In this embodiment, the players view only their own hands until all of the prayer hands and dealer hands have been set.

In one such table game embodiment, the gaming table or system includes suitable scanning or reading technologies or mechanisms that are capable of identifying the values of the dealer's cards and player's cards. In one embodiment, the card identification system further includes a card tracking program. For example, where an optical reader is included in a card shoe, a card tracking program would be able to determine the number of cards dealt and at least partially determine what cards have been dealt to the different players based in part on the rules of the game. The scanning technologies or mechanisms may be optical, based on radio frequency identification or another suitable method.

Employing a tracking system in the table game or system enables an automated determination as to how the dealer should set the cards in the dealer hands. As mentioned above, the live dealer must make a relatively quick decision regarding optimal strategy. A tracking system would alleviate the live dealer from having to make a fast decision and would prevent potential strategic errors. These tracking devices reduce the distraction of the dealer from the primary Three-card Poker game. Therefore, the gaming system disclosed herein solves the technical problem of a human dealer not being able to make such quick and accurate strategic decisions in the plays of the game regarding which of the dealer cards to set into which of the dealer hands by providing a display which instructs the dealer where to set the dealer cards, in another embodiment, a gaming system which has knowledge of player cards can signal whether a given players hand is foul. Such signaling occurs prior to player finalizing the player hands. Alternately, such signal occurs after the players hands are revealed in response to the gaming system revealing the dealer hand, where a foul player hand results in a player loss. In one embodiment, the gaming system has knowledge of both player cards and dealer cards and signals which player hands outrank the corresponding dealer hands. In this embodiment, the gaming system indicates which players are to receive awards.

Additional features and advantages are described herein, and will be apparent from, the following Detailed Description and the figures.

BRIEF DESCRIPTION OF THE FIGURES

FIG. 2B is a schematic diagram of the data network that one or more of the gaming devices of the present disclosure may be connected to.

FIG. 7 is a schematic diagram illustrating an example of dealer hand setting logic, in an embodiment.

DETAILED DESCRIPTION

The present disclosure may be implemented in various configurations for gaming machines, gaming devices or gaming systems, including but not limited to, (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
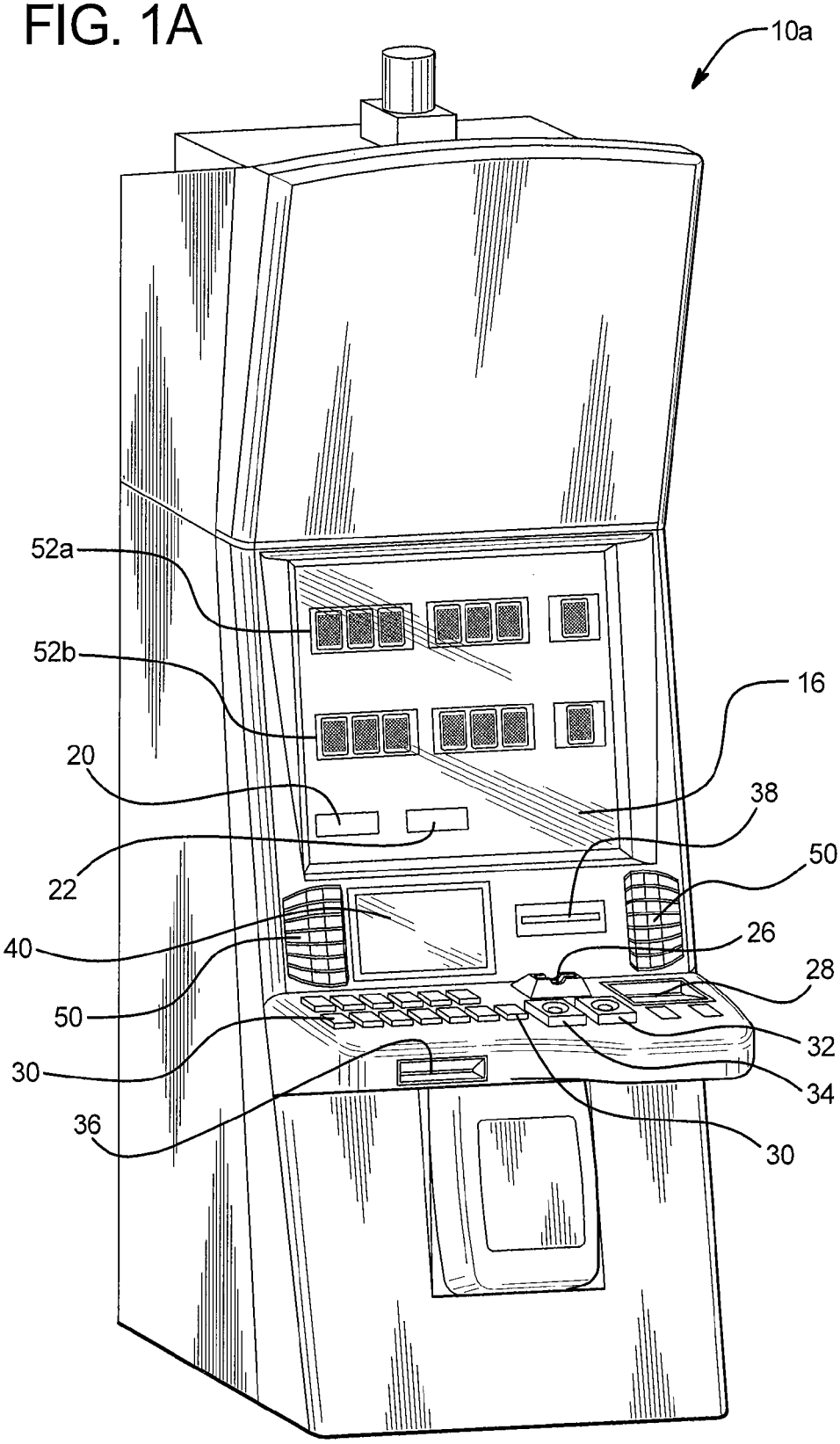
FIG. 1A is a front perspective view of one embodiment of the gaming system of the present disclosure.
Figure 1B:
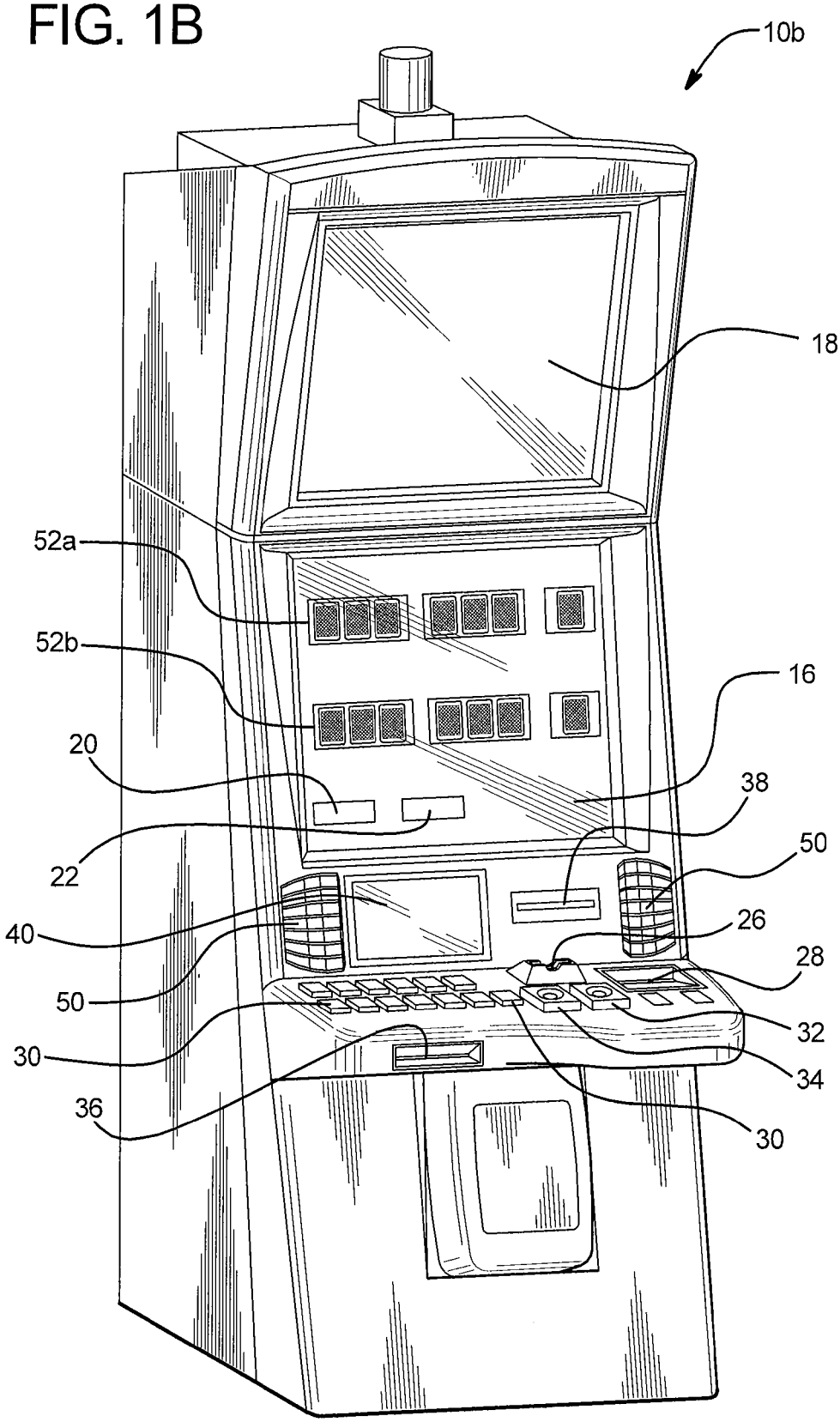
FIG. 1B is a front perspective view of one embodiment, of the gaming system of the present disclosure.

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
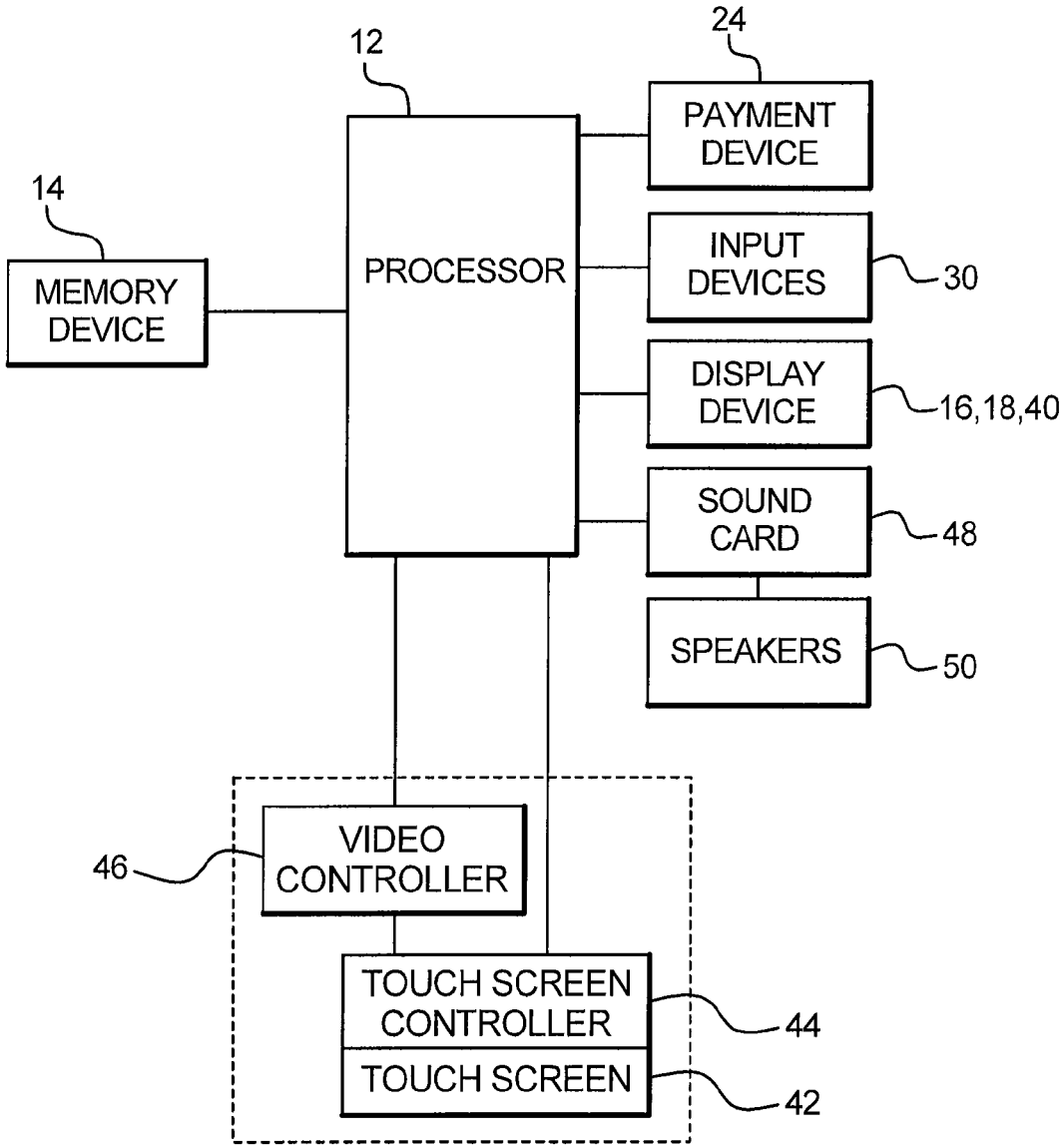
FIG. 2A is a schematic diagram of the electronic configuration of one embodiment of the gaming device of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool, Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indica displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a players identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication pods for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g. video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a multiple hand Three-Card Poker game having several dealer hands 52*a* and several player hands 52*b*. In certain of these Three-Card Poker embodiments, the gaming system or gaming device enables the player to at least play a first three-card player hand against a first three-card dealer hand, and play a second three-card player hand against a second three-card dealer hand. In one embodiment, the gaming system deals seven player and seven dealer cards. The gaming system enables the player to set the seven player cards into a high three-card player hand, a low three-card player hand and a player tie-breaker hand. The gaming system also sets the seven dealer cards into a high three-card dealer hand, a low three-card dealer hand and a dealer tie-breaker hand. The high three-card player hand competes against the high three-card dealer hand, the low three-card player hand competes against the low three-card dealer hand, and the player tie-breaker hand competes against the dealer tie-breaker hand, as discussed in further detail below. The gaming system provides the player with an award if the player wins a majority of the hands. It should be appreciated that in certain embodiments, the multiple-hand Three-Card poker game may include more that two three-card player hands and more than two three-card dealer hands.

In one embodiment, a base or primary game may be a poker game wherein the gaming device enables the player to play a conventional game of video draw poker and initially deals five cards all face up from a virtual deck of fifty-two card deck, Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In one embodiment, a base or primary game may be a multiple hand Three-Card poker game wherein the gaming device deals multiple player cards and enables the player to associate these cards with a particular poker hand, as discussed below.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities, in another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
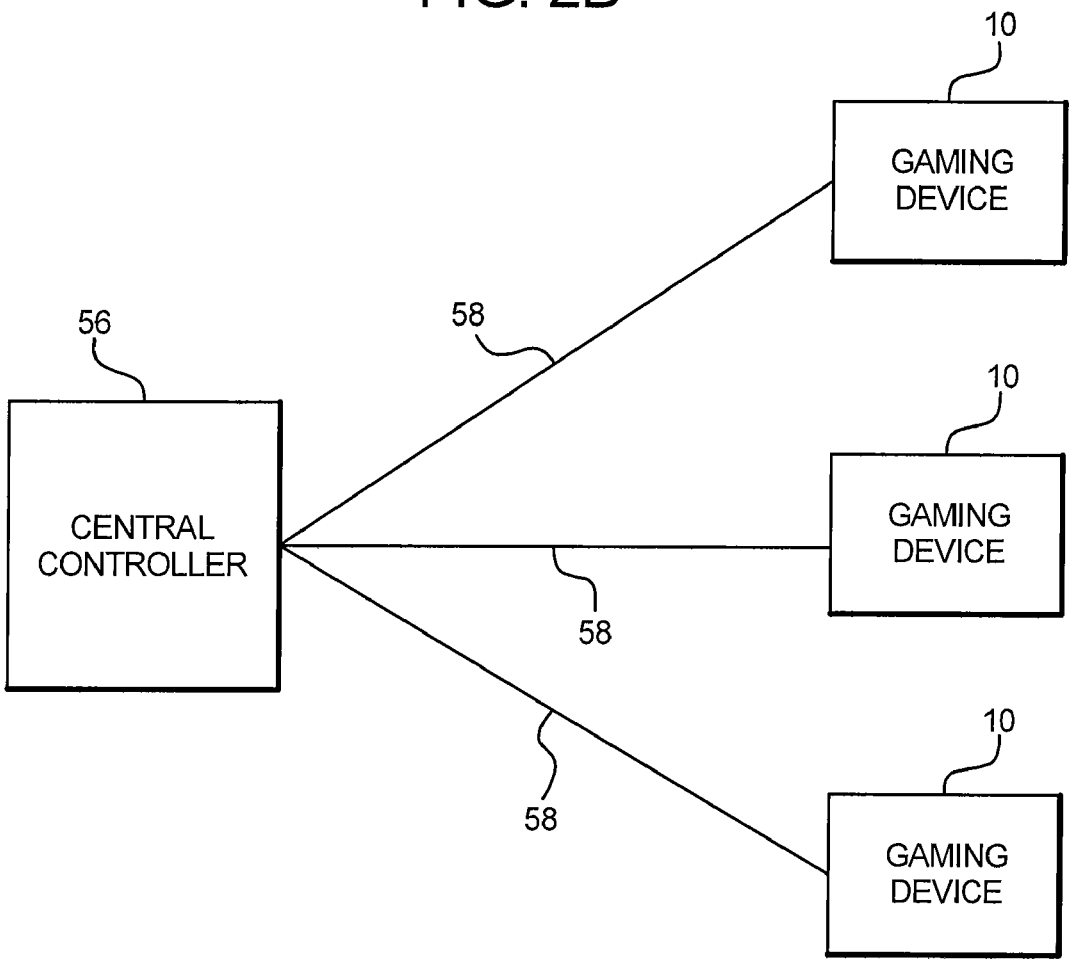

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-toss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name: the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a on a certain combination of player cards. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or card triggered event (i.e., a combination of player and/or dealer cards), such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on players wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Multiple Hand Three-Card Poker Embodiments

Figure 3A:
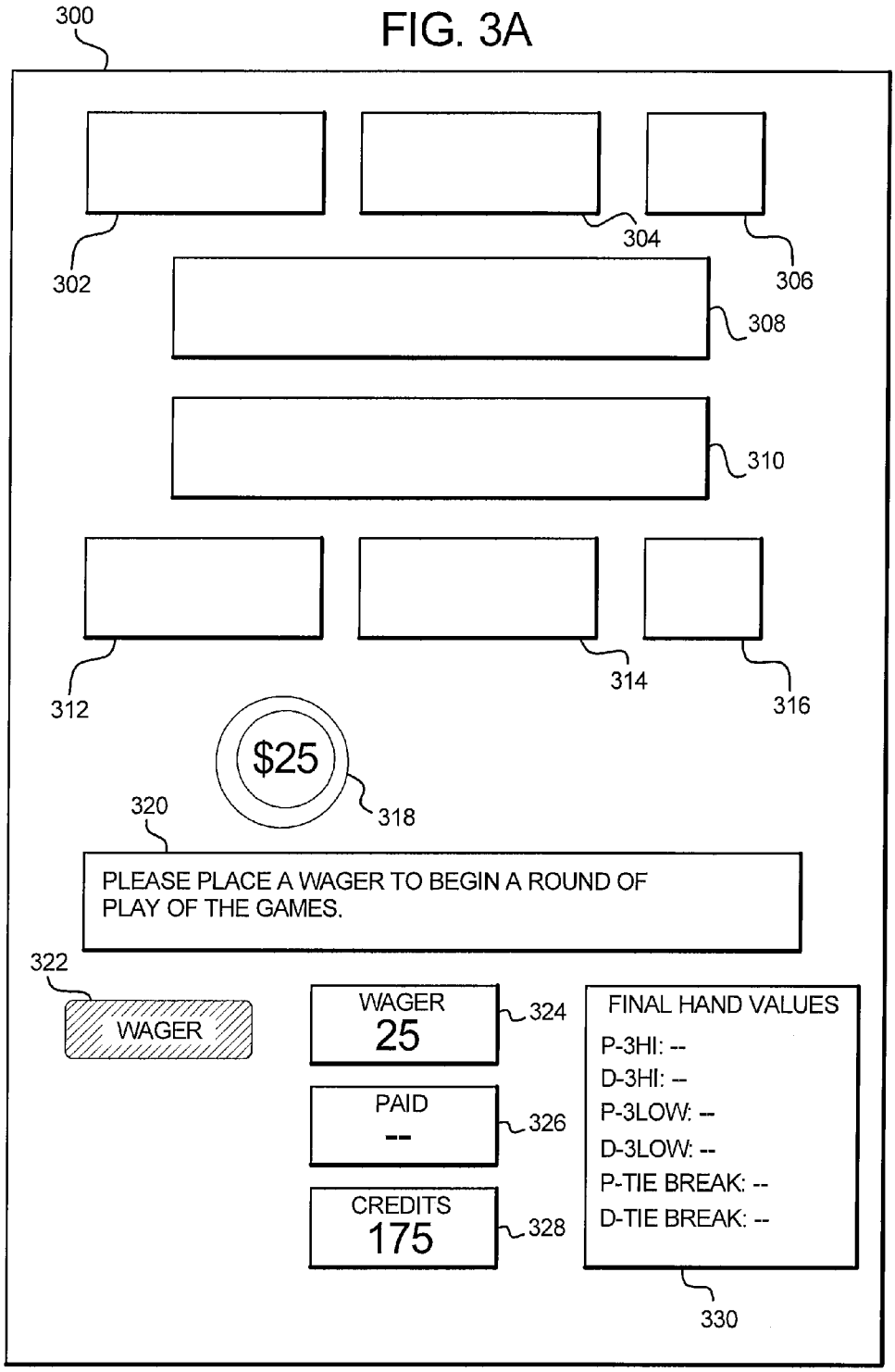
FIGS. 3A, 3B, 3C, 3D, 3E, 3F, 3G, 3H, 3I, 3J, 3K and 3L are illustrations of screen displays for a round of play of the game, where the player and the dealer both have a high three-card poker hand, a low three-card poker hand, and a tie breaker card, where the outcome of the game is decided with the tie breaker card.
Figure 3B:
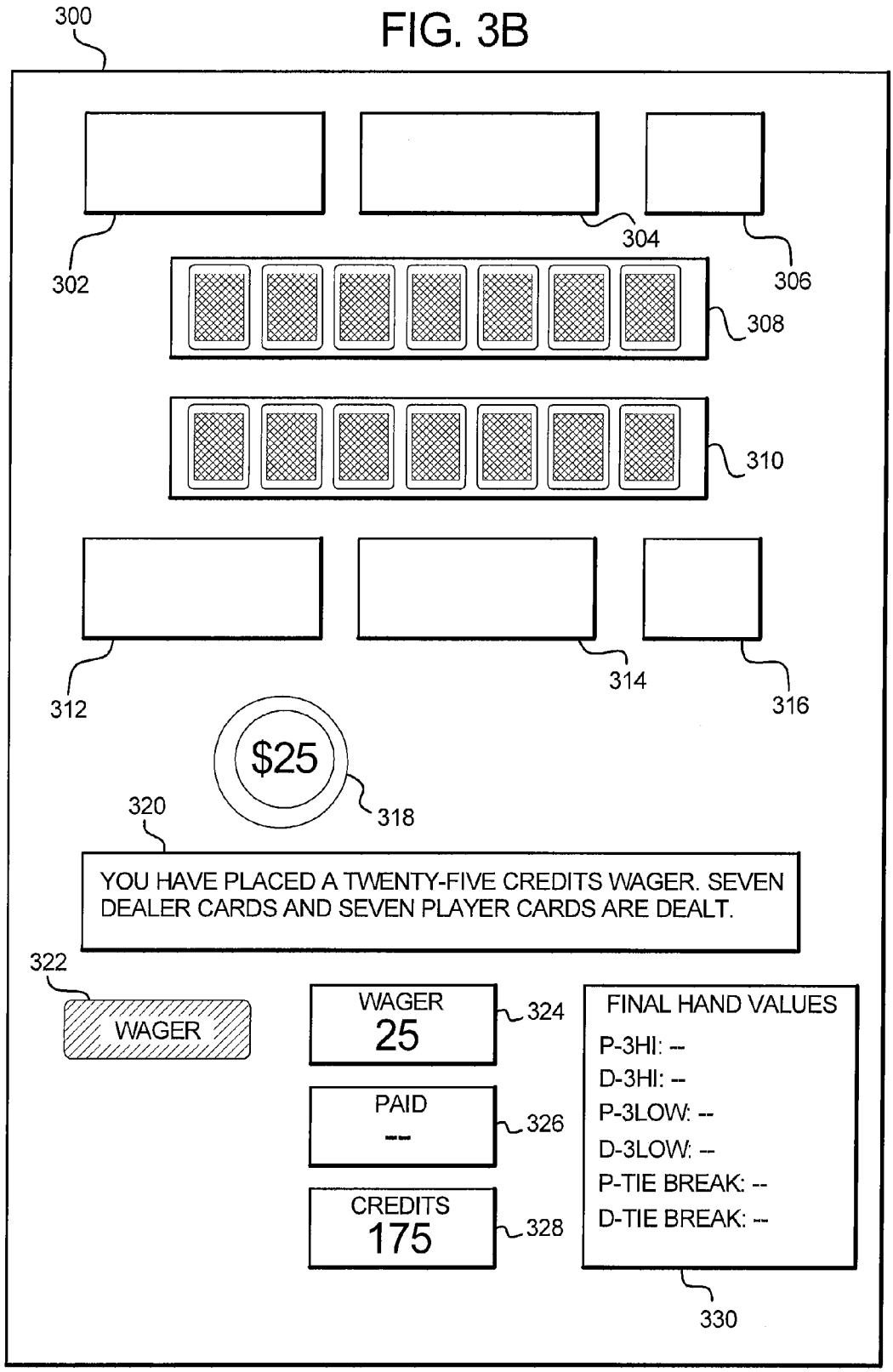

FIGS. 3A through 3L illustrate a round of play of one example game of the present disclosure. As shown in FIG. 3A, in an embodiment, the gaming system 300 incorporates a display device that includes several elements. These elements include a high three-card dealer hand area 302, a low three-card dealer hand area 304, and a dealer tie-breaker card area 306. The gaming system 300 also includes a dealer card area 308 and a player card area 310. Similar to the high, low, and tie-breaker card areas for the dealer, the gaming system 300 also includes a high three-card player hand area 312, a low three-card player hand area 314, and a player tie-breaker card area 316. The gaming system 300 includes a wager area 318, a message display 320, a wager input 322, a wager display 324, and a paid display 326, a credits display 328, and a final hand value display 330. It should be appreciated that the gaming system 300 may include any number of suitable displays and/or inputs to facilitate play of the game.

As shown in FIG. 3A, the gaming system 300 prompts the player to place a wager to begin a round of play of the game, as indicated in message display 320. As shown in FIG. 3A, the player has elected to place a 25 credit wager on this round of play of the game, as indicated by the activated wager input 322, the wager display 324, and the credit token in the wager area 318. After the player elects to place a twenty-five credit wager, the gaming system 300 causes the credits display 328 to be reduced from an initial credit amount of two-hundred credits, down to a credit amount of one-hundred seventy five.

In this embodiment, the gaming system 300 deals a plurality of player cards into the player card area 310, and a plurality of cards into the dealer card area 308. The cards are dealt from a single virtual conventional deck of fifty-two cards. In other embodiments, two or more decks of virtual cards may be used. The number of cards in a deck and the number of decks used may vary. As shown in FIG. 36, gaming system 300 deals seven dealer cards face-down in the dealer card area 308. The gaming system 300 also deals seven player cards face-down in the player card area 310, as also indicated in the message display 320.

Figure 3C:
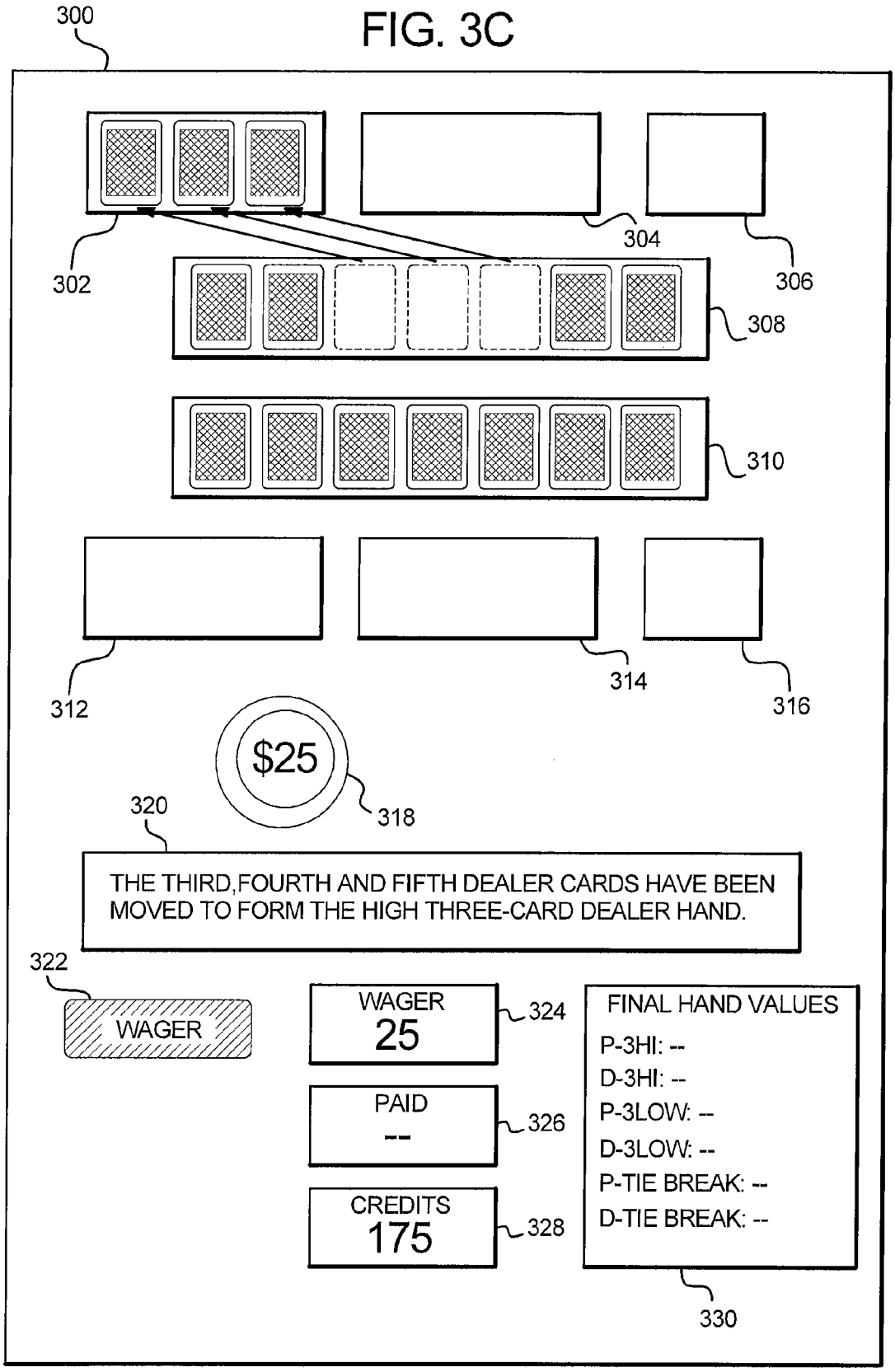

As shown in FIG. 3C, the gaming system 300 causes three of the dealer cards to be moved from the dealer card area 308 to the high three-card dealer hand area 302. Although these three-cards, as shown in FIG. 3C, appear face-down to the player, it should be appreciated that the gaming system includes appropriate programming logic such that the gaming system 300 selects three-cards to form the high three-card dealer hand area 302, such that the high three-card dealer card 302 will rank higher than the resulting low three-card dealer hand area 304, and the dealer tie-breaker card area 306. In the example play of the game, as shown in FIG. 3C, the gaming system 300 selects the third, fourth and fifth dealer cards from the dealer card area 308 to form the high three-card dealer hand area 302. This is also indicated to the player in the message display 320.

Figure 3D:
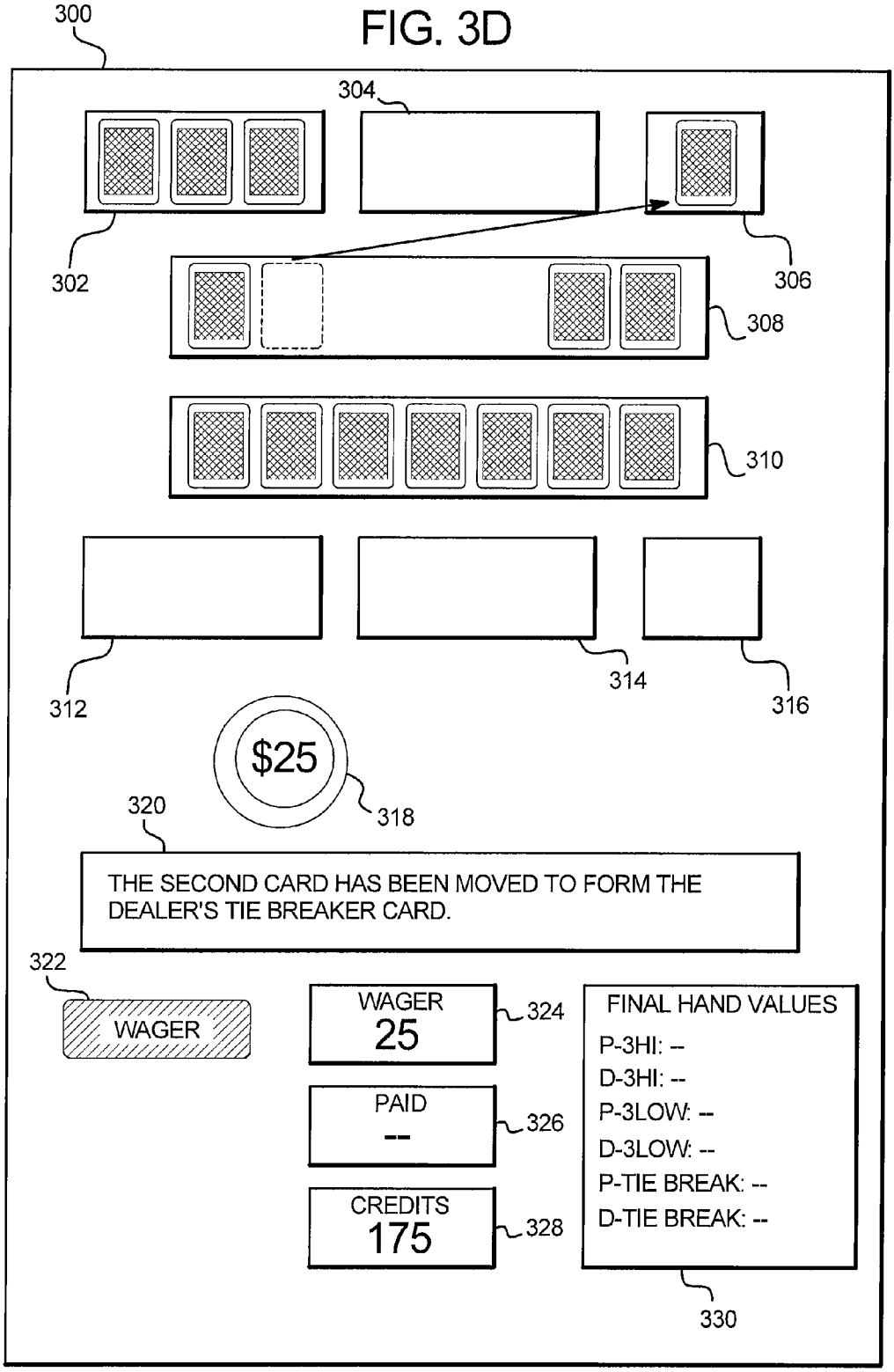
Figure 3E:
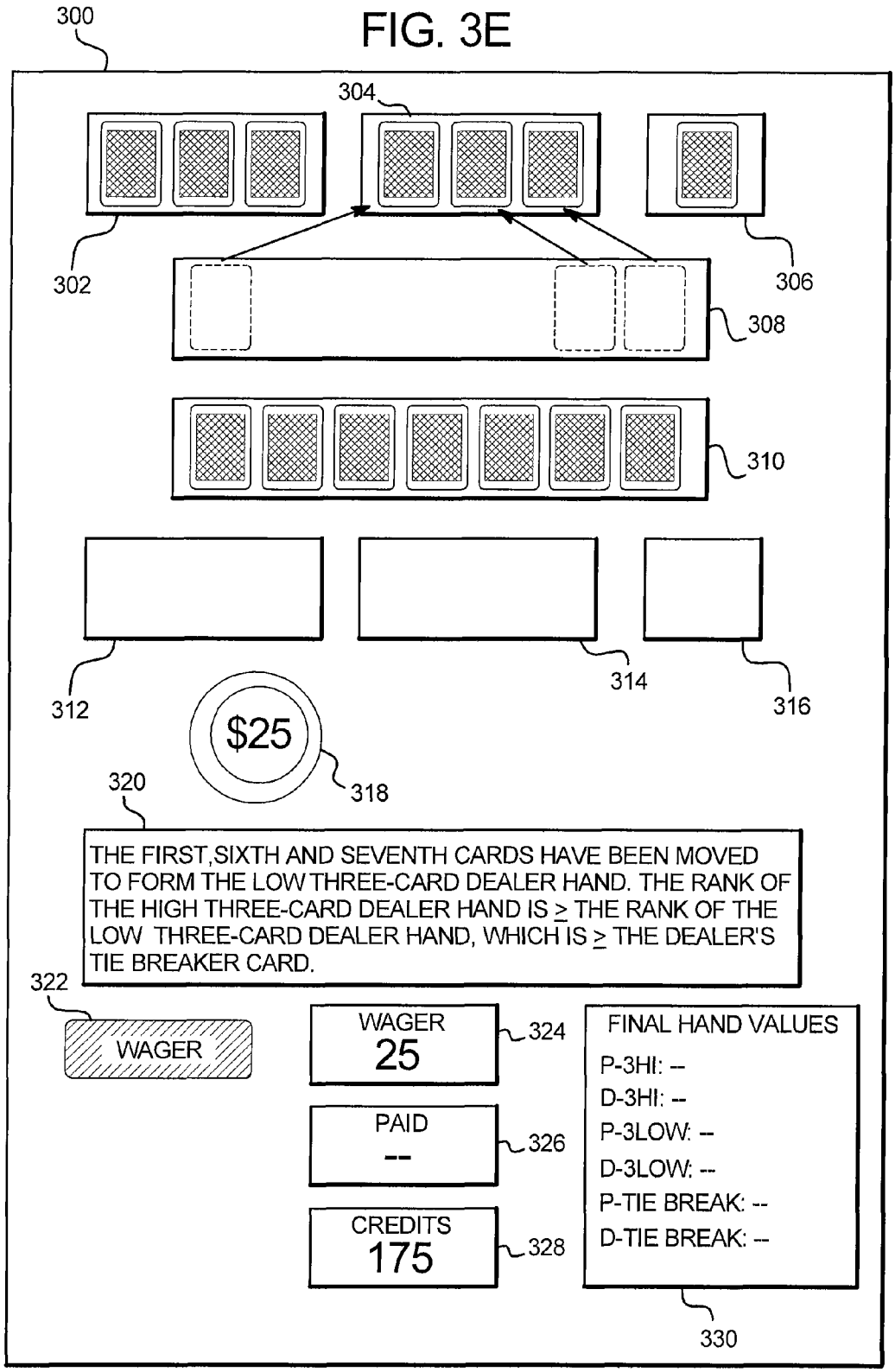

As shown in FIG. 3D, the gaming device 300 next selects a single card to form the dealer tie-breaker card area 306. In this example, gaming system 300 selects the second dealer card from the dealer card area 308 to be the dealer tie-breaker card area 306, as also indicated by the message display 320. Therefore, at this point, gaming system 300 has selected four of the total seven cards to form the high three-card dealer hand area 302, and the dealer tie-breaker card area 306. As shown in FIG. 3E, the gaming system 300 automatically causes the remaining three dealer cards to be moved from the dealer card area 308 to the low three-card dealer hand area 304. This is indicated in FIG. 3E by the arrows drawn from the dealer card area 308 to the low three-card dealer hand area 304, and also, as indicated in the message display area 320. As also indicated in the message display 320, and according to the game rules, the rank of the high three-card dealer hand is greater than or equal to the rank of the low three-card dealer hand. Moreover, the rank of the low three-card dealer hand is greater than or equal to the value of the dealer tie-breaker card area 306. At this point in the play of the game, the player is still unable to view the cards in the two three-card dealer hands 302, 304, and the dealer tie-breaker card area 306. For a video-based gaming system, there are potential benefits to having the dealer act first. One such potential benefit is that novice players can learn by the example of the gaming system certain of the mechanics in setting hands. Another potential benefit is that by visually conveying to a player that the dealer cards are being set first, this confirms to the player that information about the player cards is not being used when setting the dealer hands. However, it should be appreciated that in other embodiments, all of the players set their hands before the dealer cards are set by the dealer or gaming system.

Figure 3F:
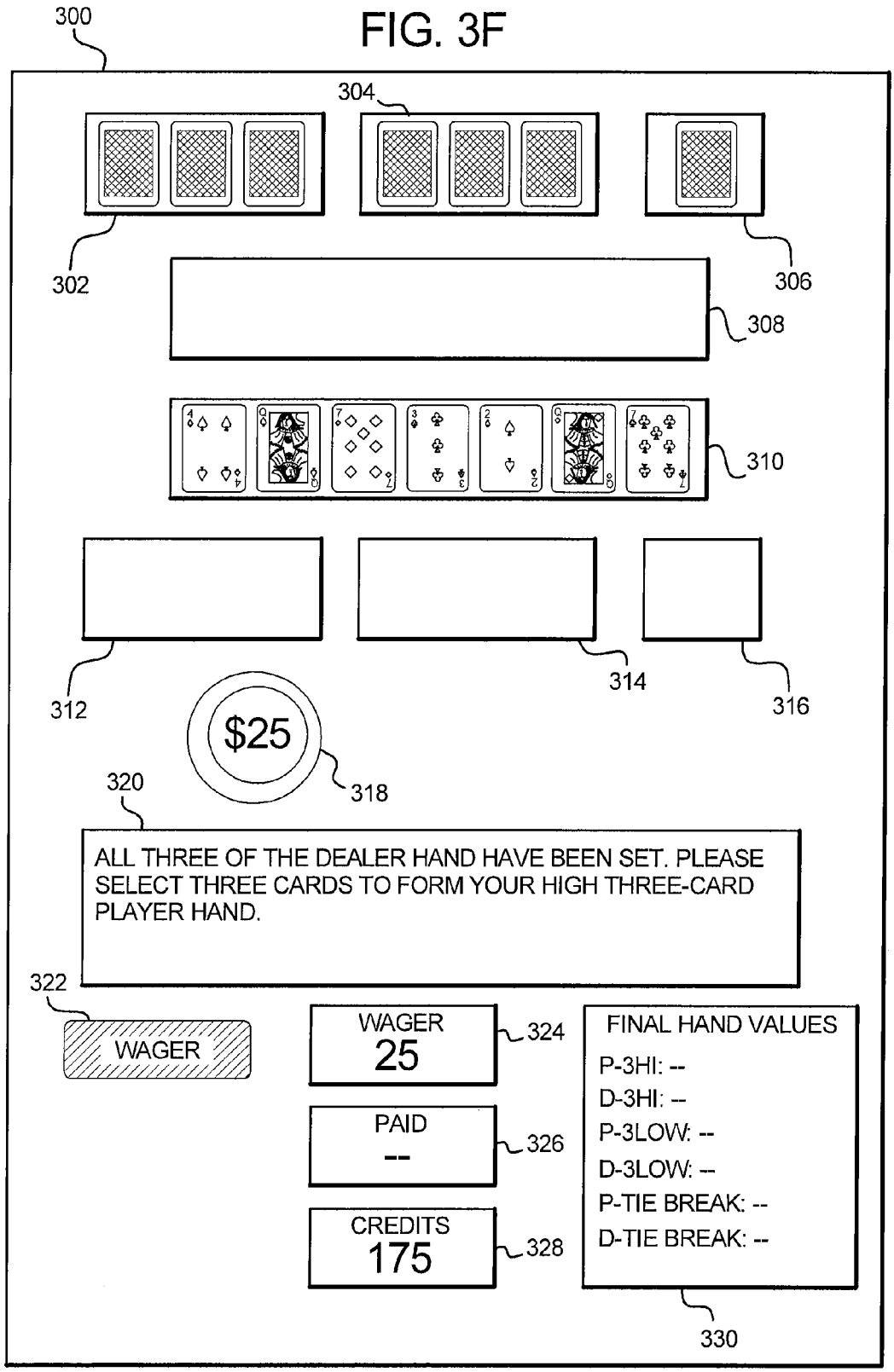
Figure 3G:
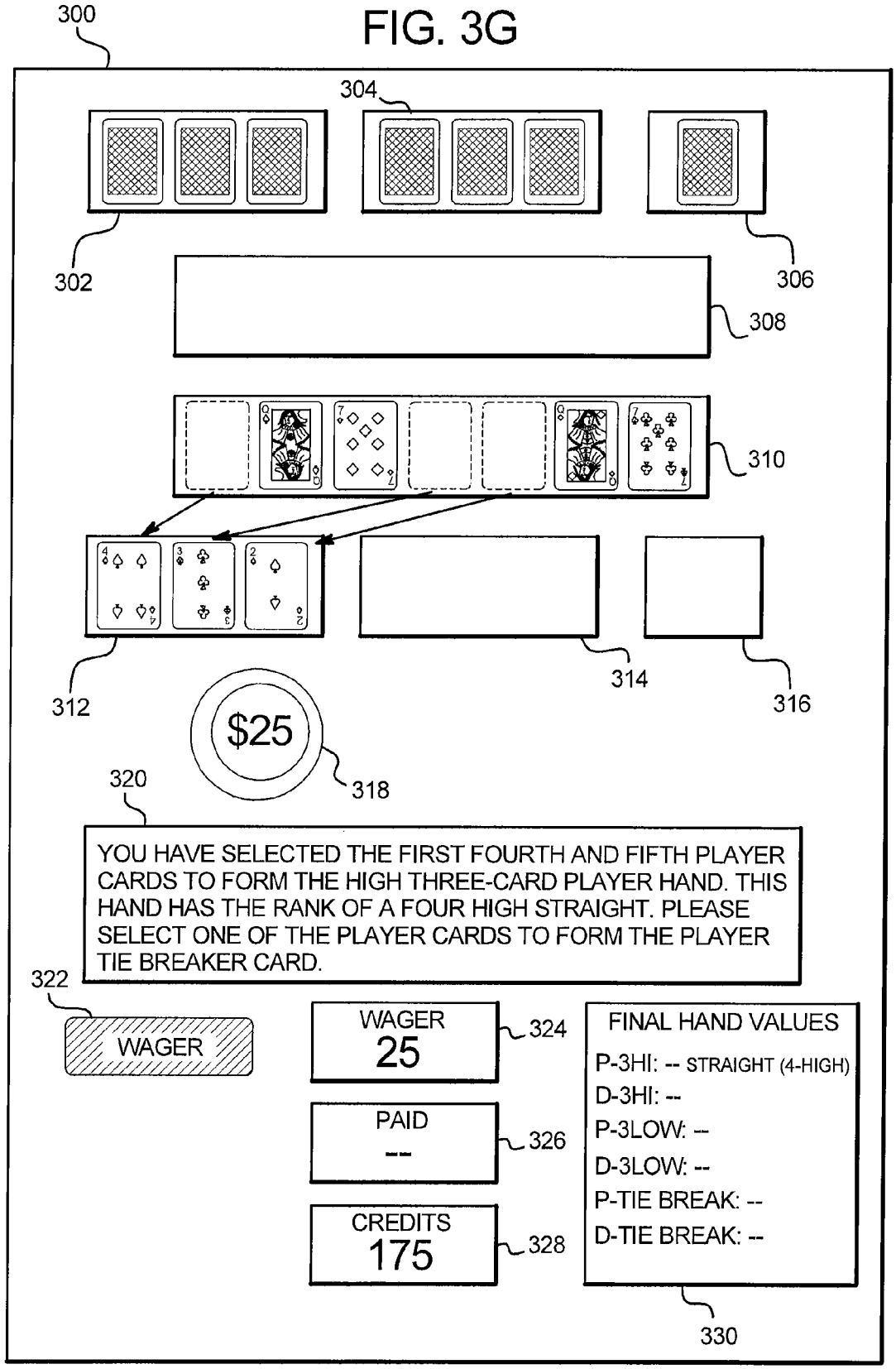

As shown in FIG. 3F, the gaming system 300 causes the cards in the player card area 310 to be revealed to the player. In this example play of the game, the seven cards in the player card area 310 include 4♠, Q♠, 7♦, 3♣, 2♠, Q♦, and 7♣. The gaming system 300 informs the player that all three of the dealer hands have been set, and instructs the player to selected three-cards to form the high three-card player hand area 312, as also indicated in message display 320. As shown in FIG. 3G, the player has selected the first player card, the fourth player card, and fifth player card to form the high three-card player hand area 312. These three-cards to form the high three-card player hand area 312 include the 4♠, 3♠, and 2♠. The formed high three-card player hand area 312 has a rank of a four high straight, as indicated in the message display 320, and in the final hand value display 330. At this point in the game, the values of the cards in the high three-card dealer hand area 302 are still not known to the player. As shown in the message display 320 in FIG. 3G, the gaming system 300 instructs the player to select one of the remaining player cards to form the player tie-breaker card, as indicated by message display 320.

Figure 3H:
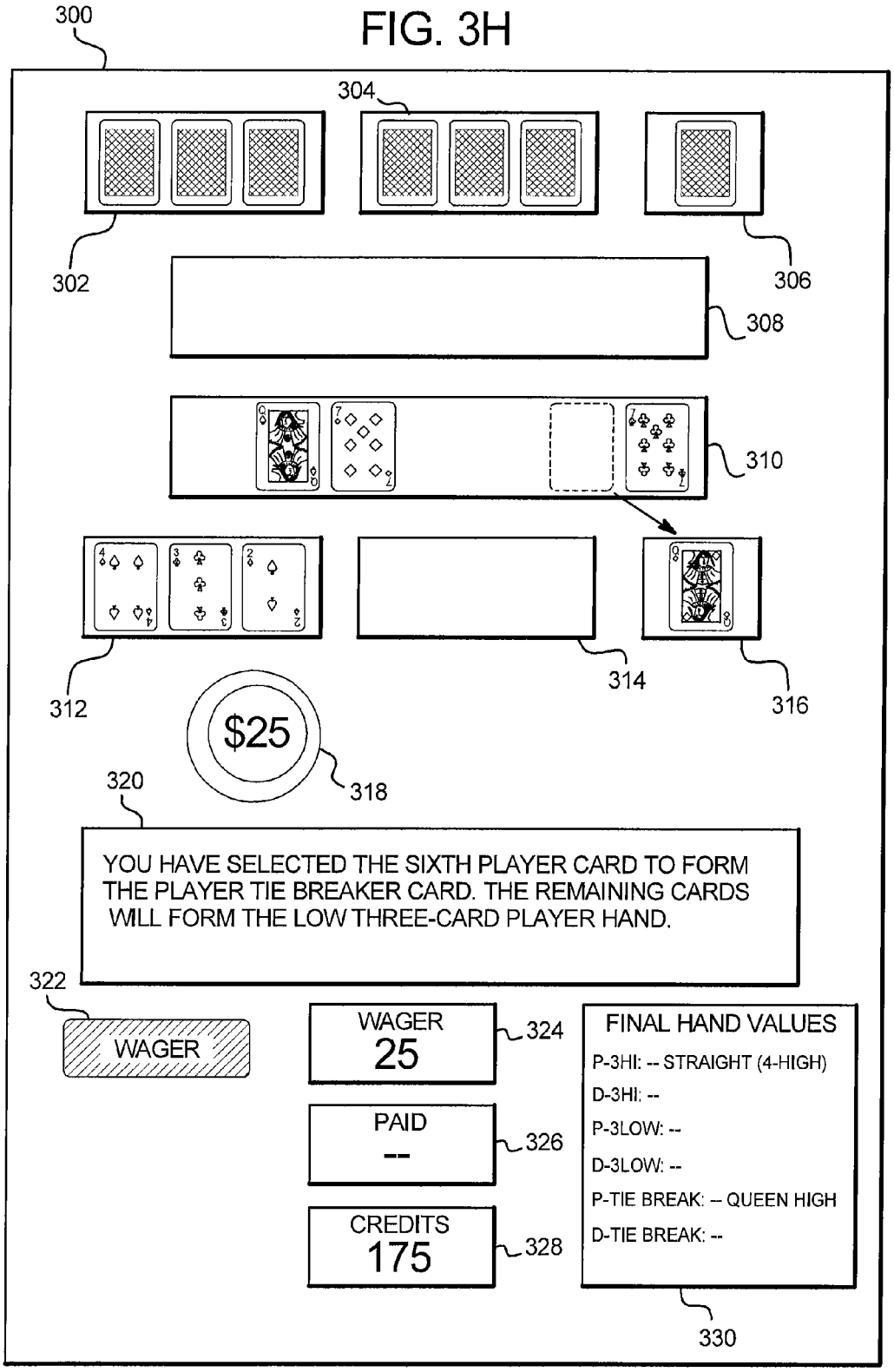
Figure 3I:
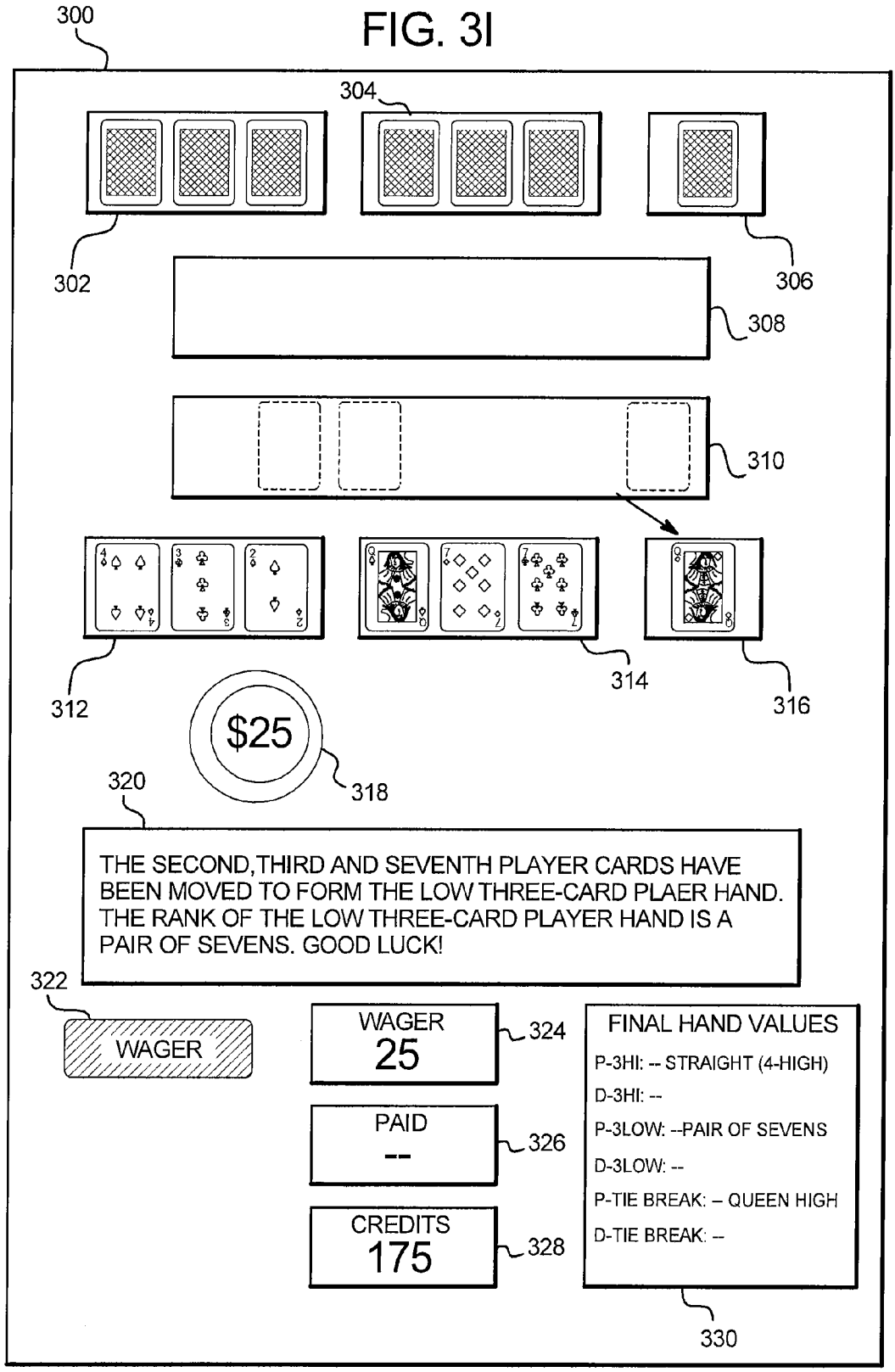

As shown in FIG. 3H, the player selected the sixth player card from the player card area 310 to be the player tie-breaker card area 316. This card is the Q♦, as also indicated in the final hand value display 330. The gaming system 300 then instructs the player that the remaining three-cards in the player card area 310 will automatically be moved to form the low three-card player hand area 314. It should be appreciated that in other embodiments, the player can set cards in any order in any of the three player hands until two of the hands are set. Once two of the hands are set, the gaming system 300 can automatically determine that the remaining cards must go to the only incomplete player hand remaining.

Figure 5A:
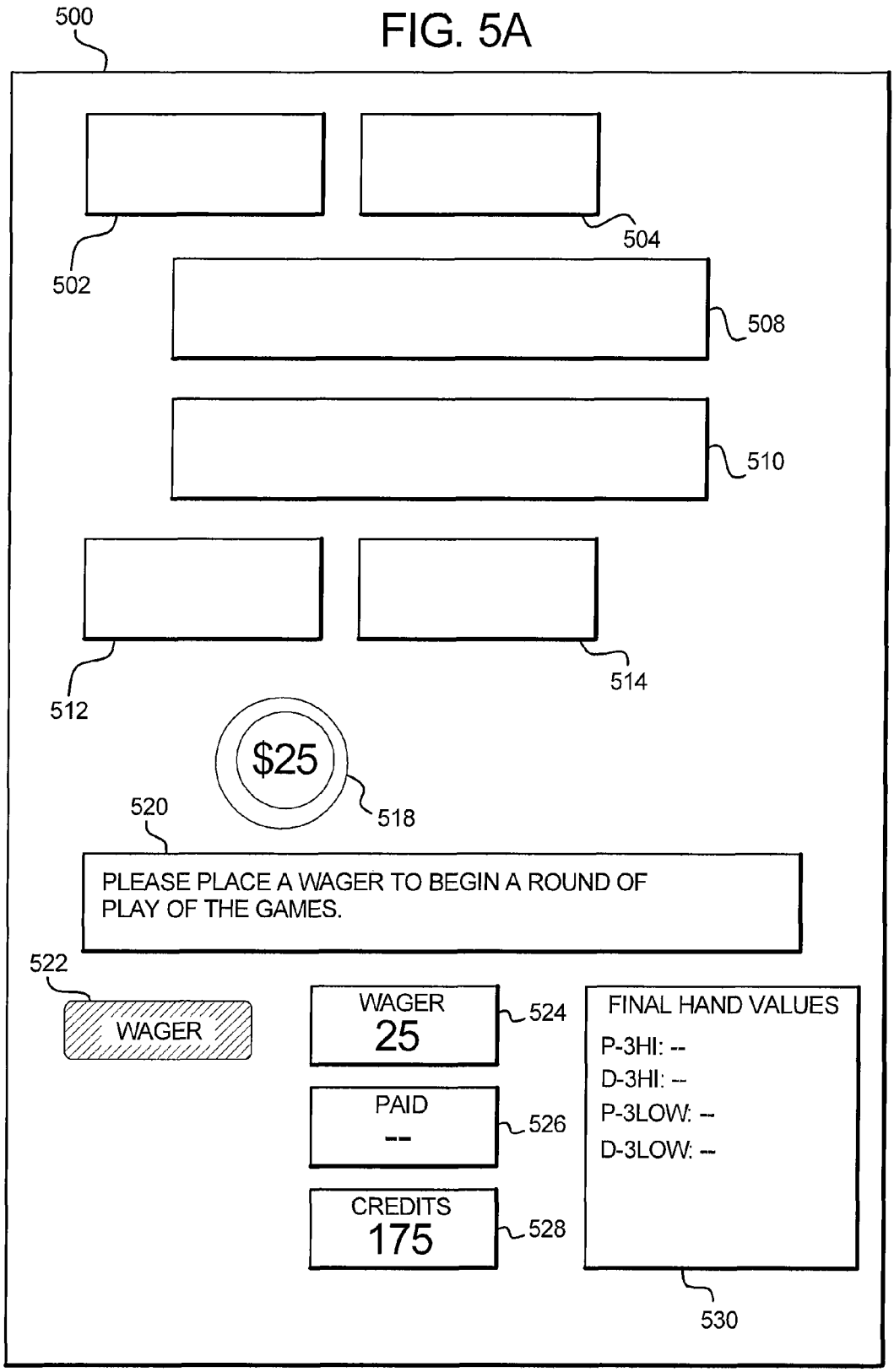
FIGS. 5A, 5B and 5C, 5D, 5E, 5F, 5G, 5H and 5I are illustrations of screen displays for a round of play of the game, where the player and the dealer both have a high three-card poker hand and a low three-card poker hand.
Figure 5B:
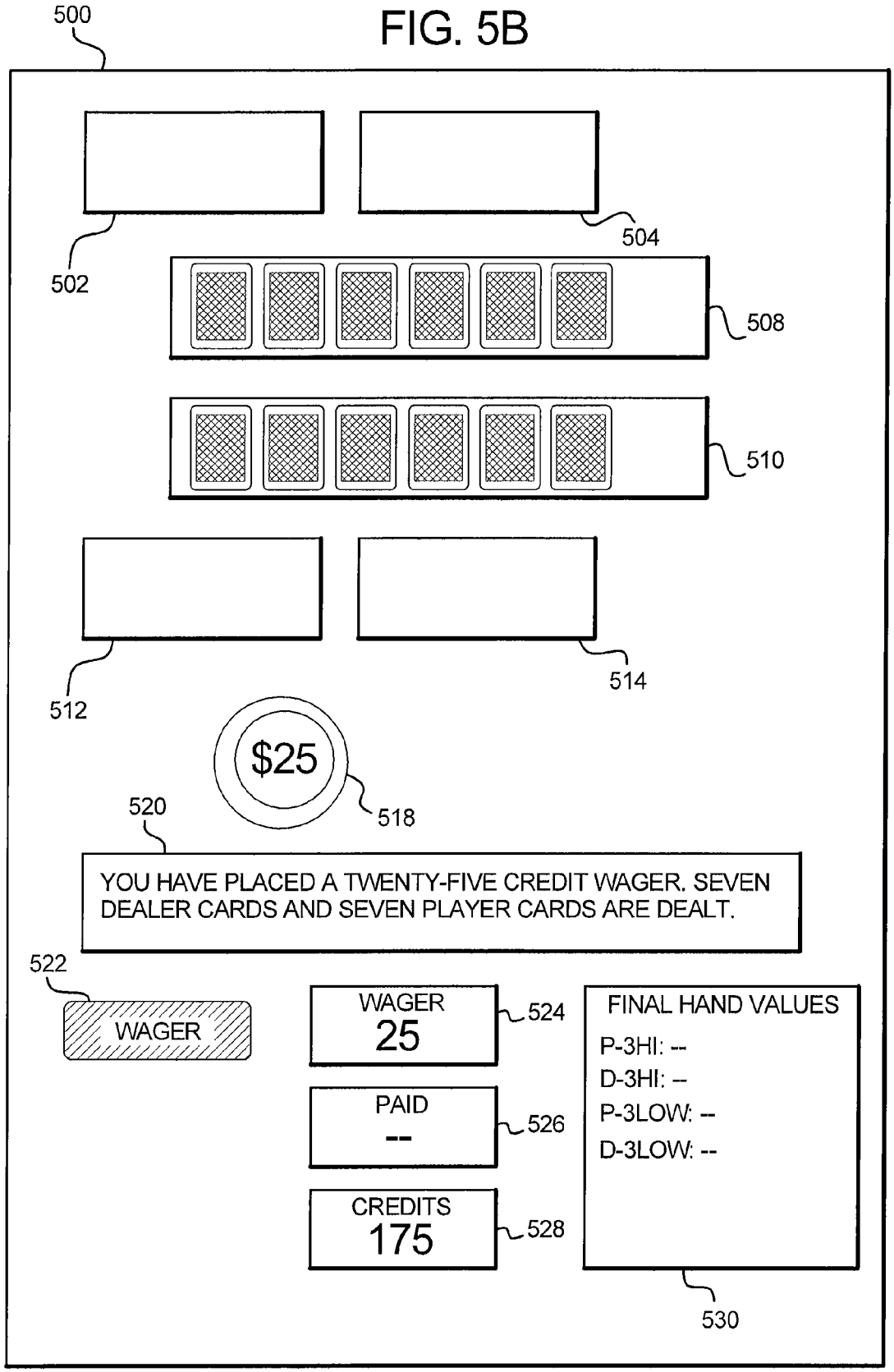
Figure 5C:
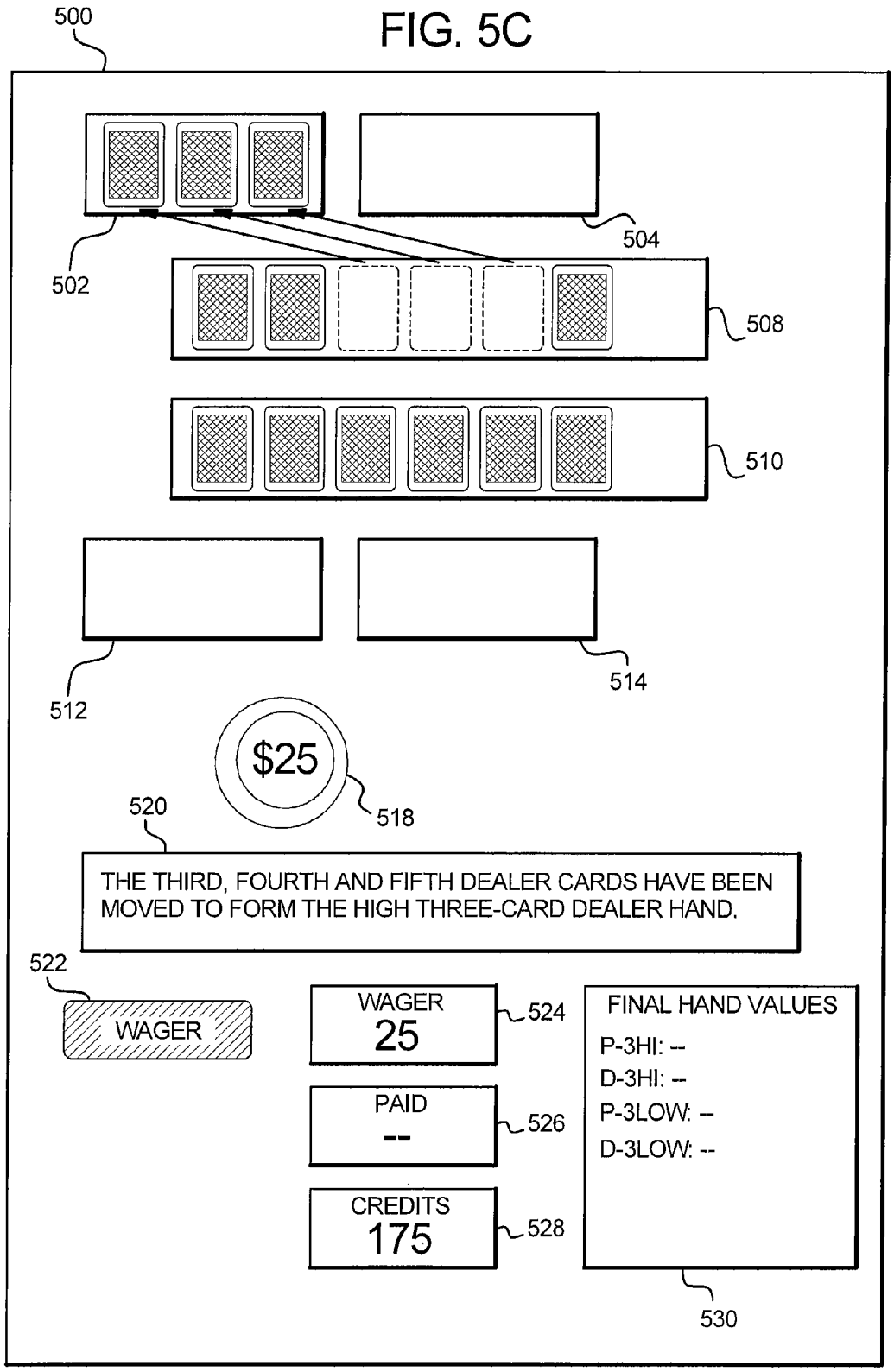
Figure 5D:
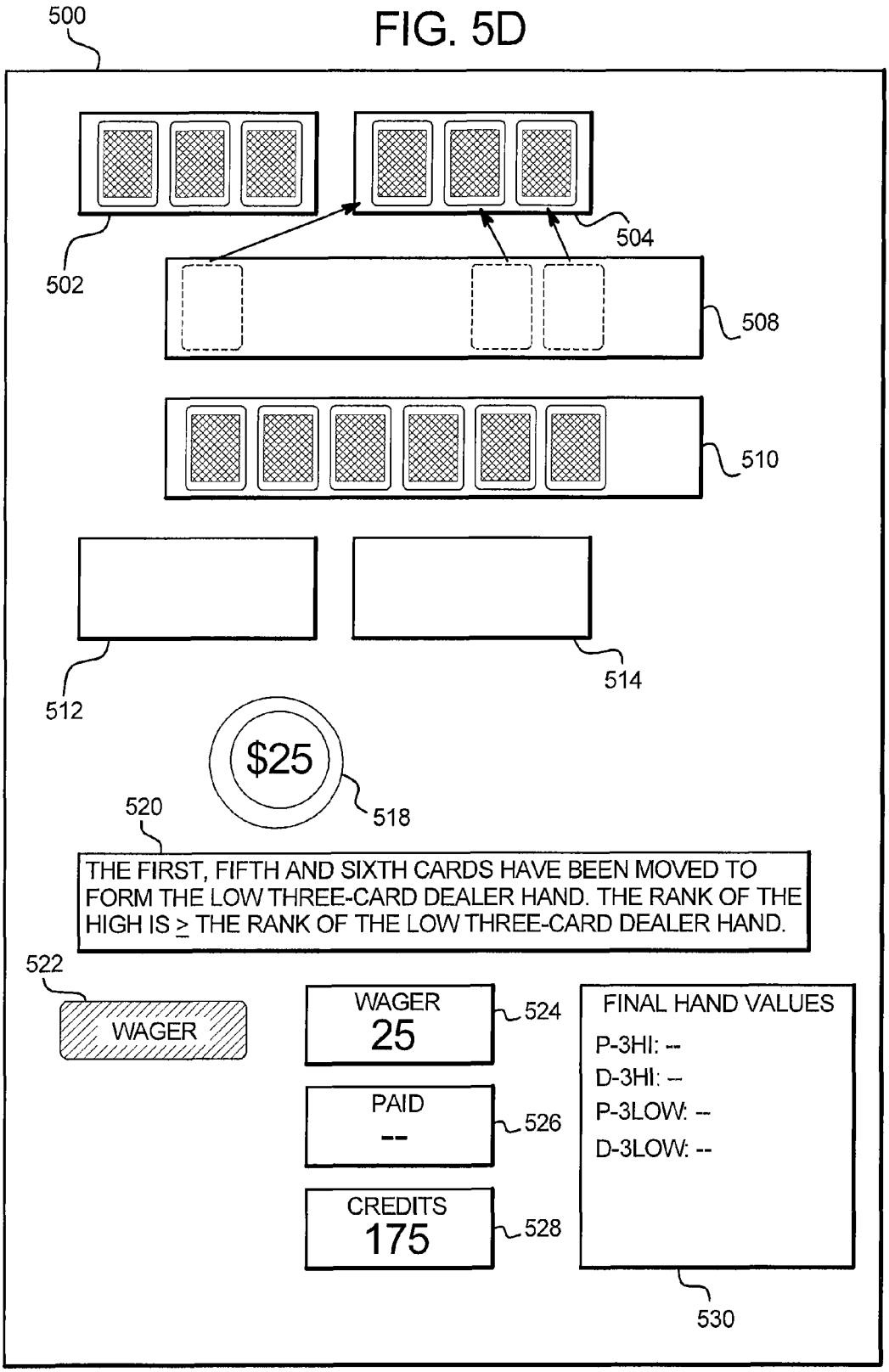
Figure 5E:
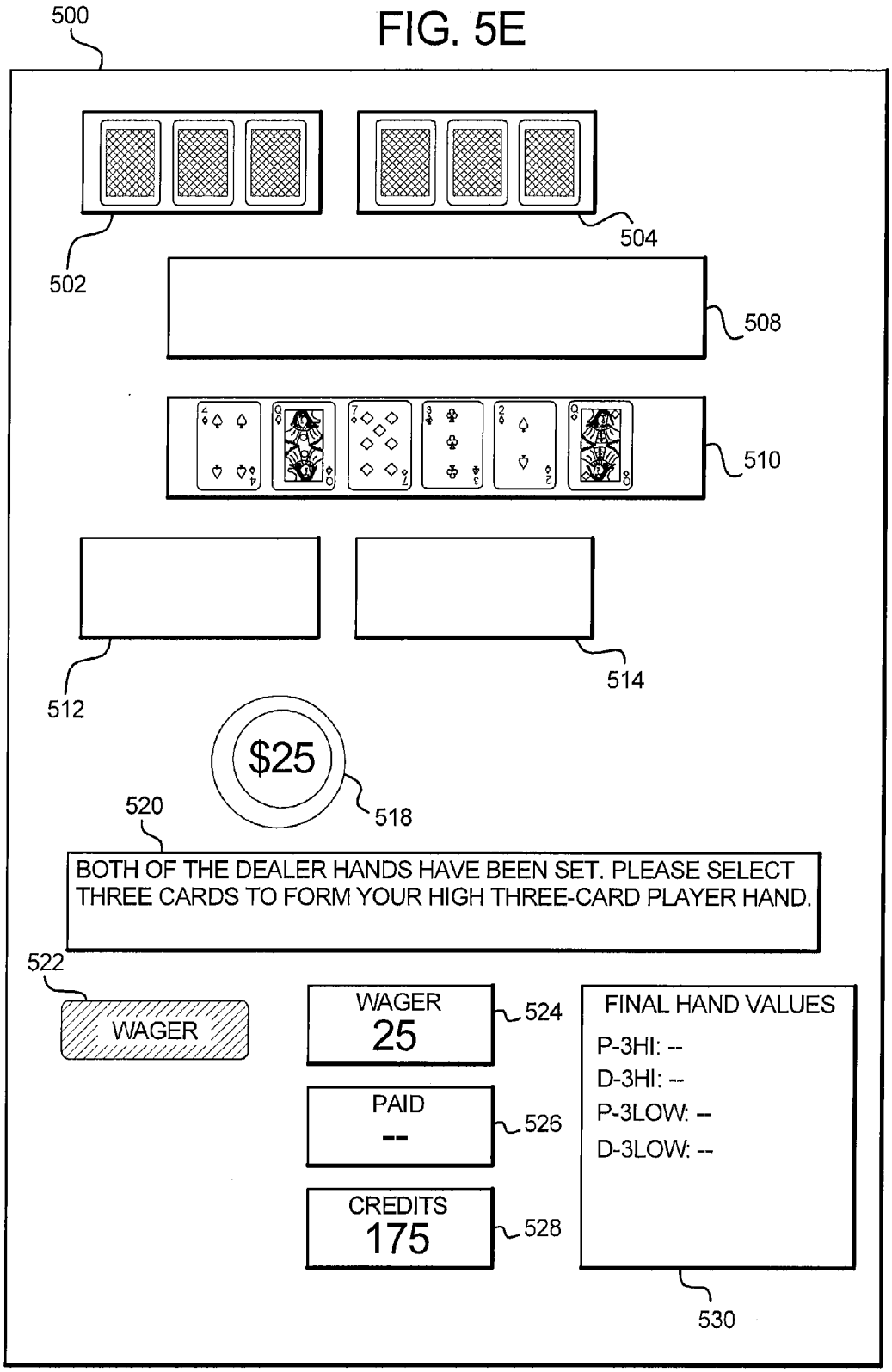
Figure 5F:
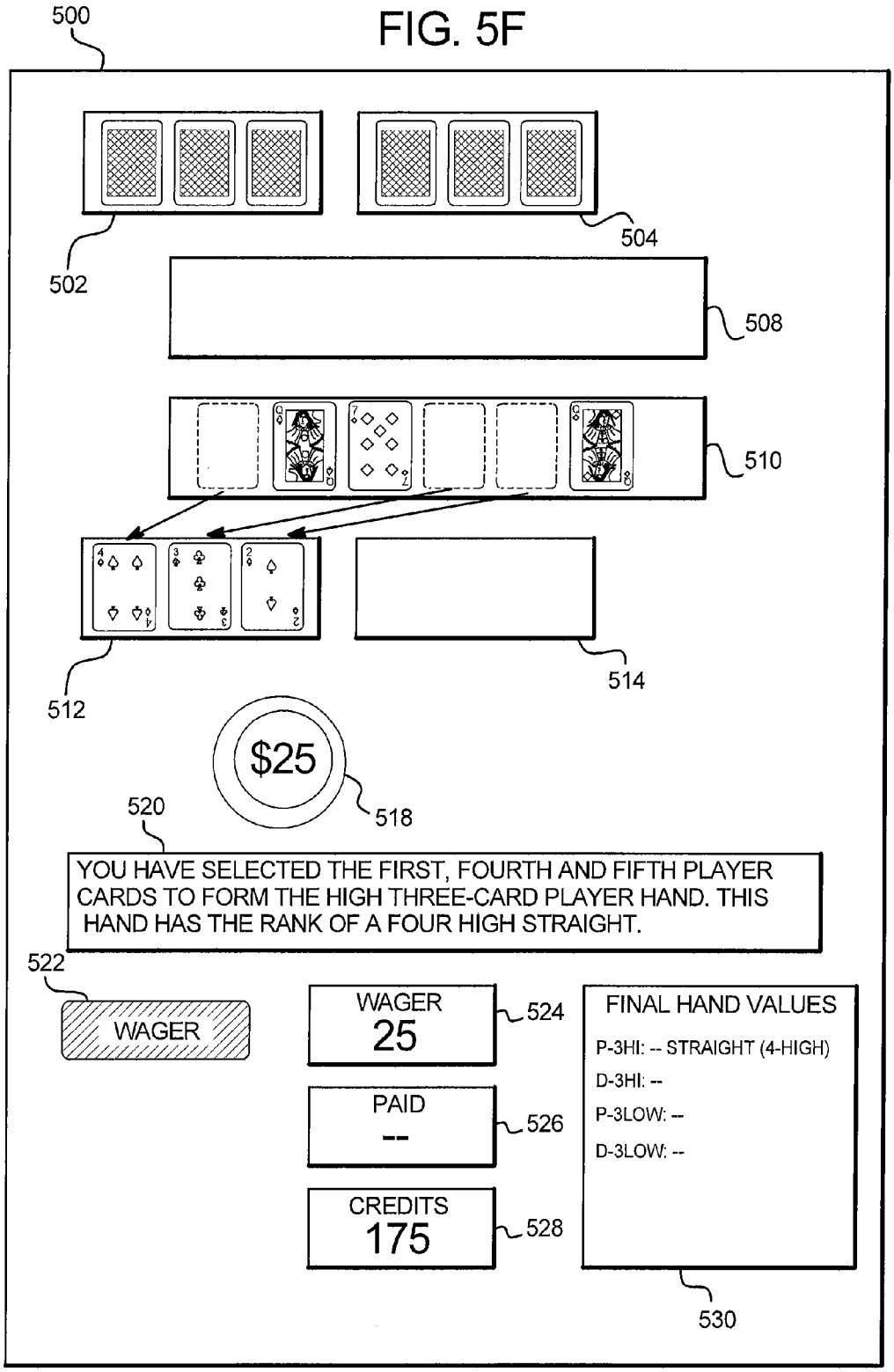
Figure 5G:
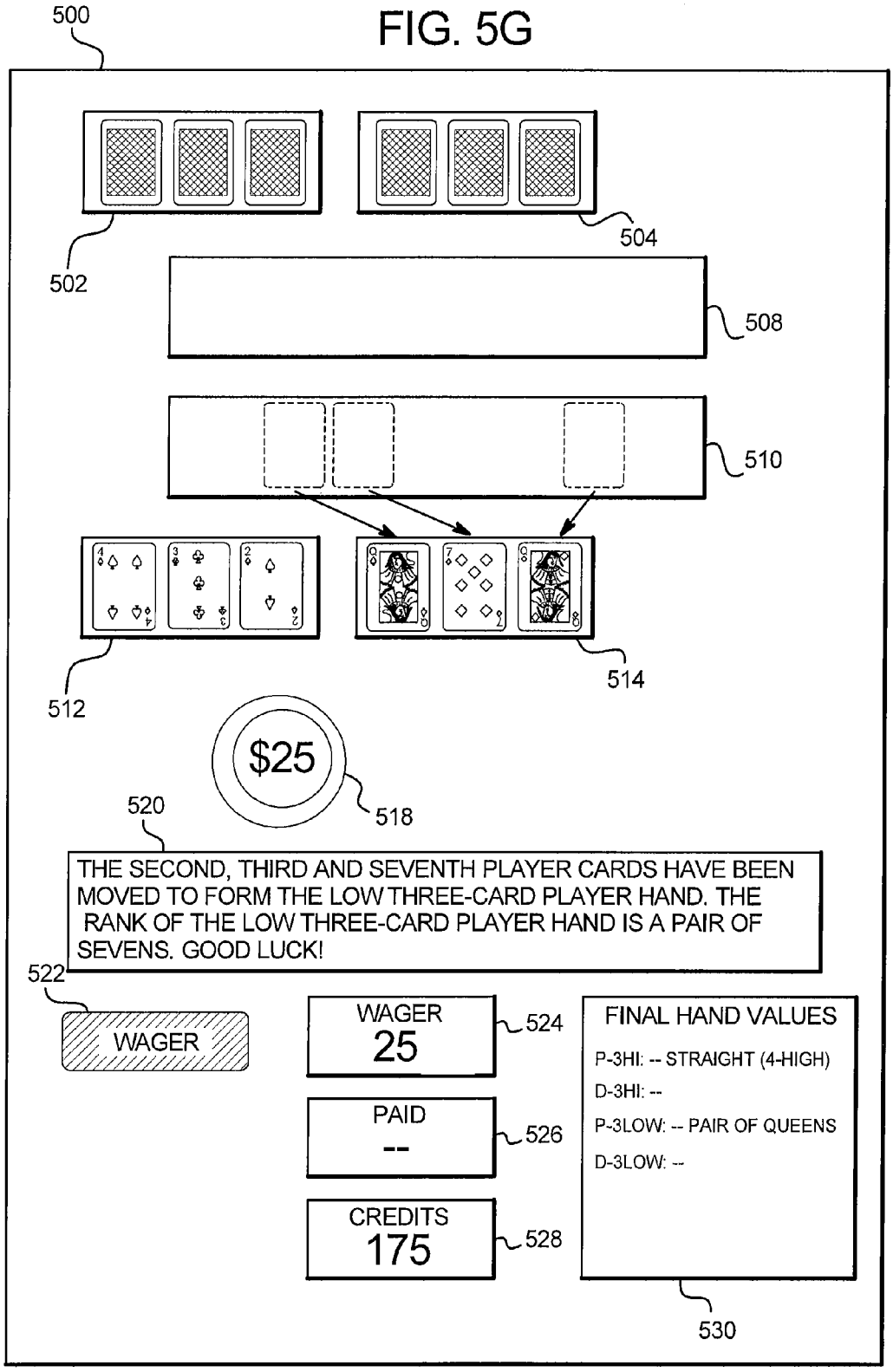
Figure 5H:
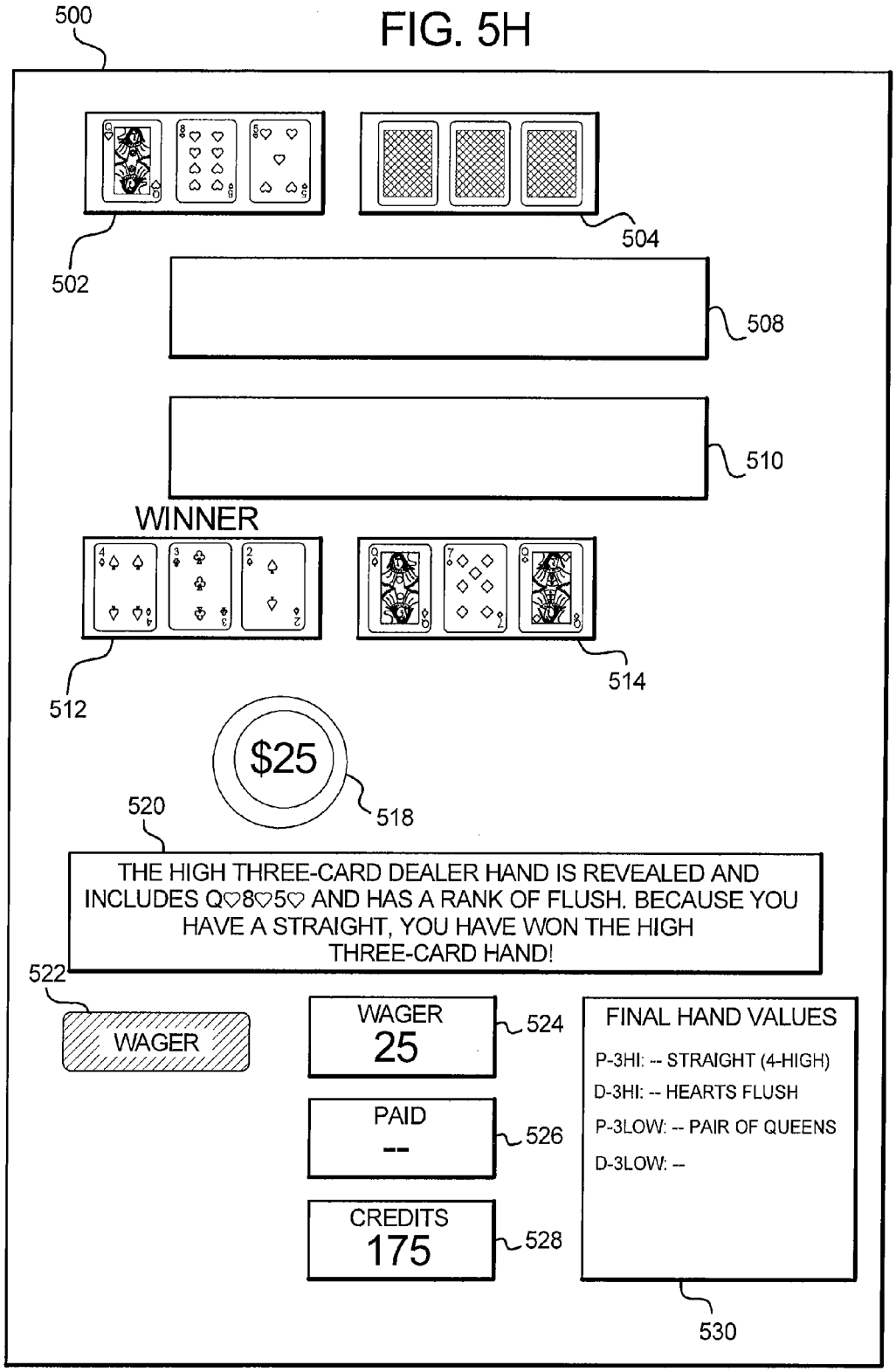
Figure 5I:
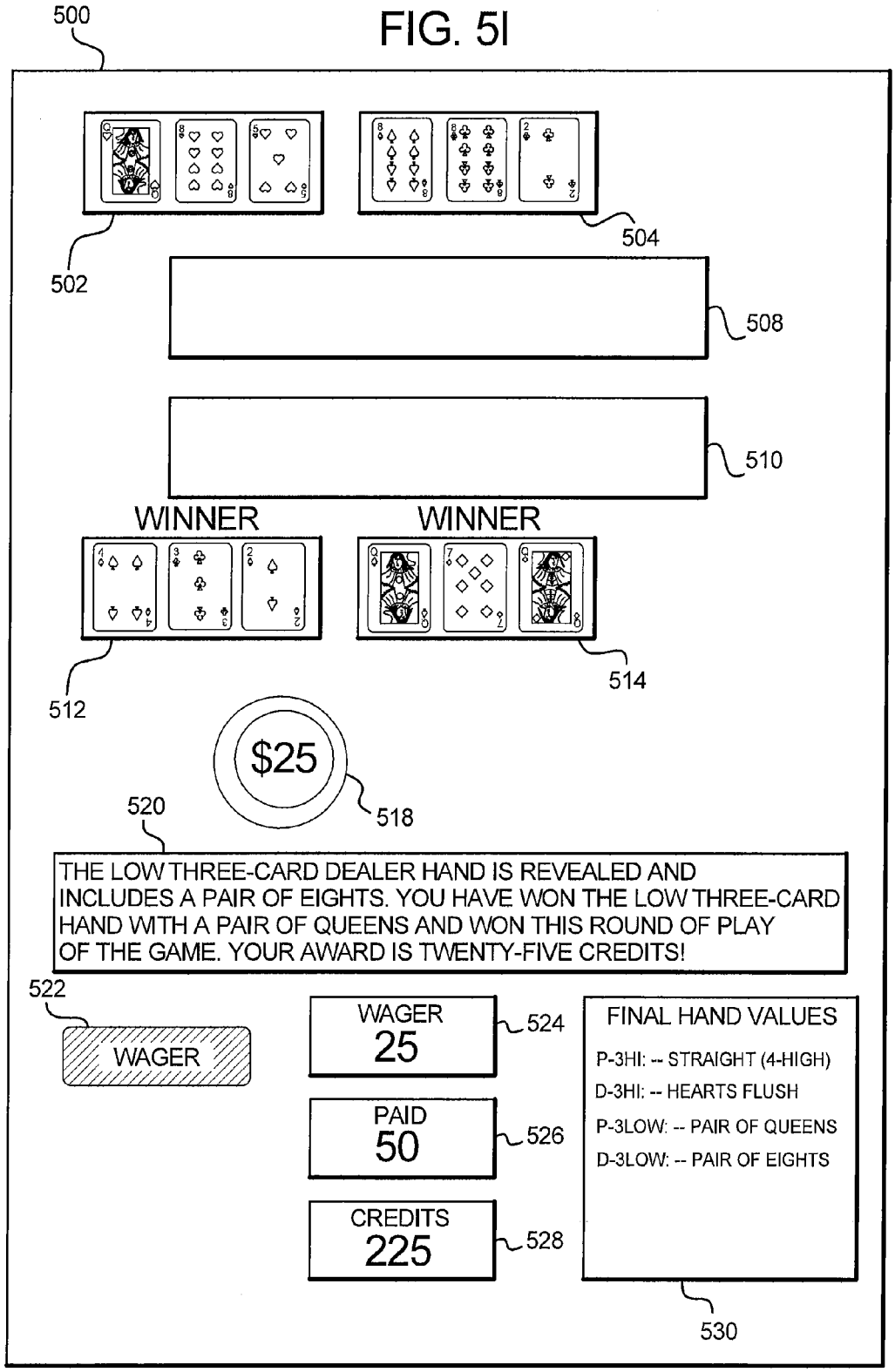

As shown in FIG. 5I, the second, third, and seventh player cards have been moved from the player card area 310 to form the low three-card player hand area 314 which is also indicated by the phantom lines in the player card area 310 and the directional arrows pointing to the low three-card player hand area 314. The rank of the low three-card player hand area 314 is a pair of sevens, as indicated in message display 320 and in the final hand value display 330. Accordingly the player has set all three of the player hands such that the rank of the high three-card player hand (four-high straight) is greater than the rank of the low three-card player hand area 314 (pair of sevens) which is greater than or equal to the rank of the player tie-breaker card area 316 (Queen high). In this example the player presumably made a strategic decision to forego the option of having a higher ranking low three-card player hand area 314 in favor of having a relatively high-ranking tie-breaker card. Therefore, the player may be foregoing a higher chance of winning both the high three-card player hand area 312 and the low three-card player hand area 314, in order to have a better chance to win the tie-breaker hand. That is, under certain circumstances, if the player has a high enough ranking on a high three-card player hand, the player may choose to forego the option of having a high-ranking low three-card player hand area 314 in order to assure a high probability of winning the tie-breaker hand. In other words, if the player were to have set a pair of queens to be part of the low three-card player hand and lost, the chances that the player would win the tie-breaker hand with only a seven high would be lower. In another embodiment, the player is required to confirm that his or her hand is set to their satisfaction before proceeding to the showdown against the dealer. In another embodiment, the gaming system will check that the players hands conform to the required setting rules and if they do not, will inform the player of the problem and require the player to reset the player hands correctly.

Figure 3J:
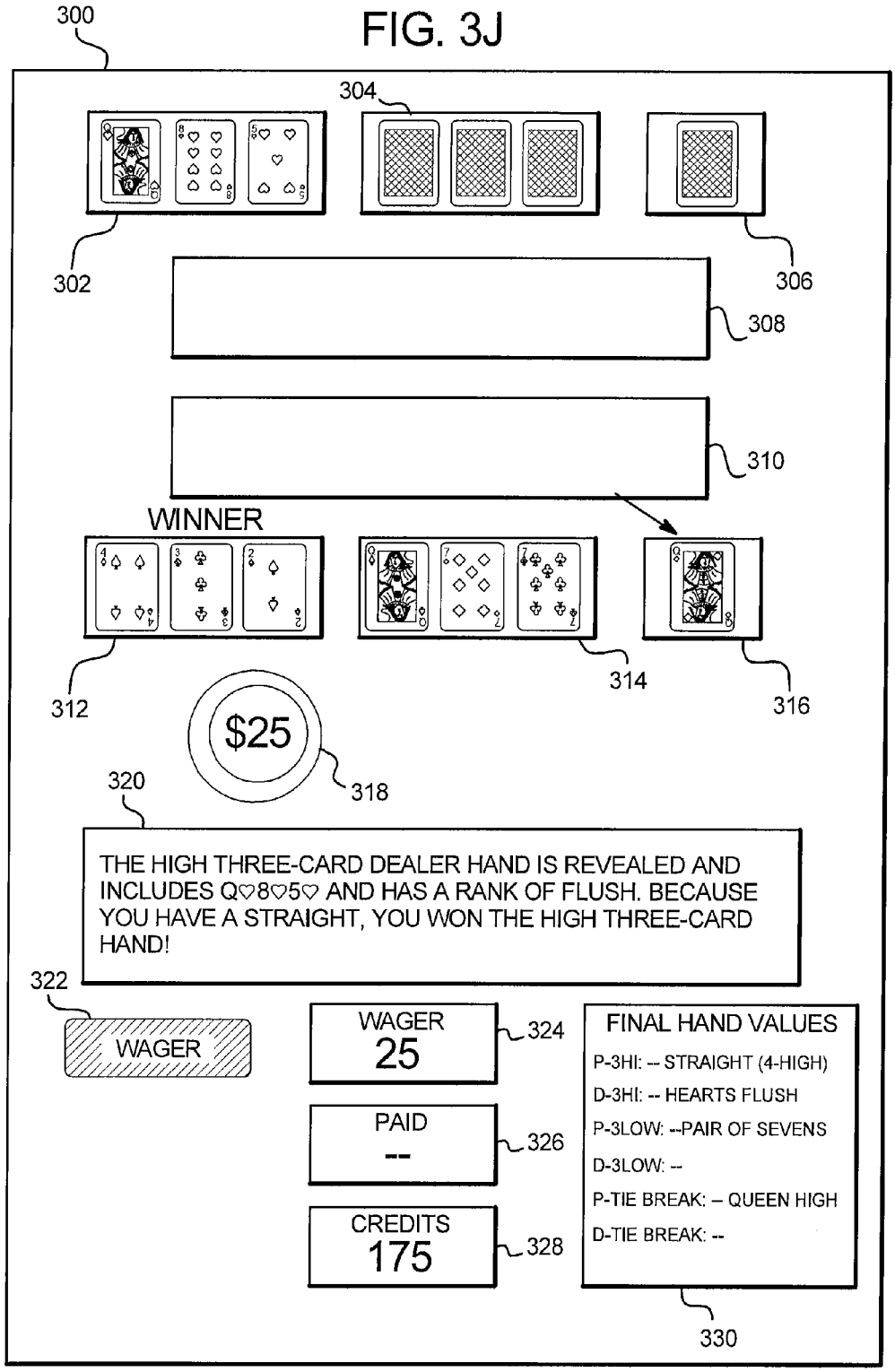

As shown in FIG. 3J, the gaming system 300 reveals the values of the cards in the high three-card dealer hand area 302. In this example, play of the game, these cards include the Q♥, 8♥ and the 5♥, as indicated also in message display 320 and final hand value display 330. Therefore, for the high hands, the high three-card player hand area 312, which has a value of a four-high straight, outranks the rank of the high three-card dealer hand area 302, which is a flush. It is also to be noted that in three-card poker, the rank of a straight is higher than the rank of a flush, which is contrary to the rankings in traditional Five Card Draw Poker, where the flush is a higher ranking hand. The gaming system causes an indication to be displayed to the player that the player has won the high three-card hand as indicated on message display 320, and by the winner symbol adjacent to the high three-card player hand area 312. Thus, because the player has already won one hand, the player is only required to either win the low three-card hand or the tie-breaker hand in order to win the overall pray of the game.

Figure 3K:
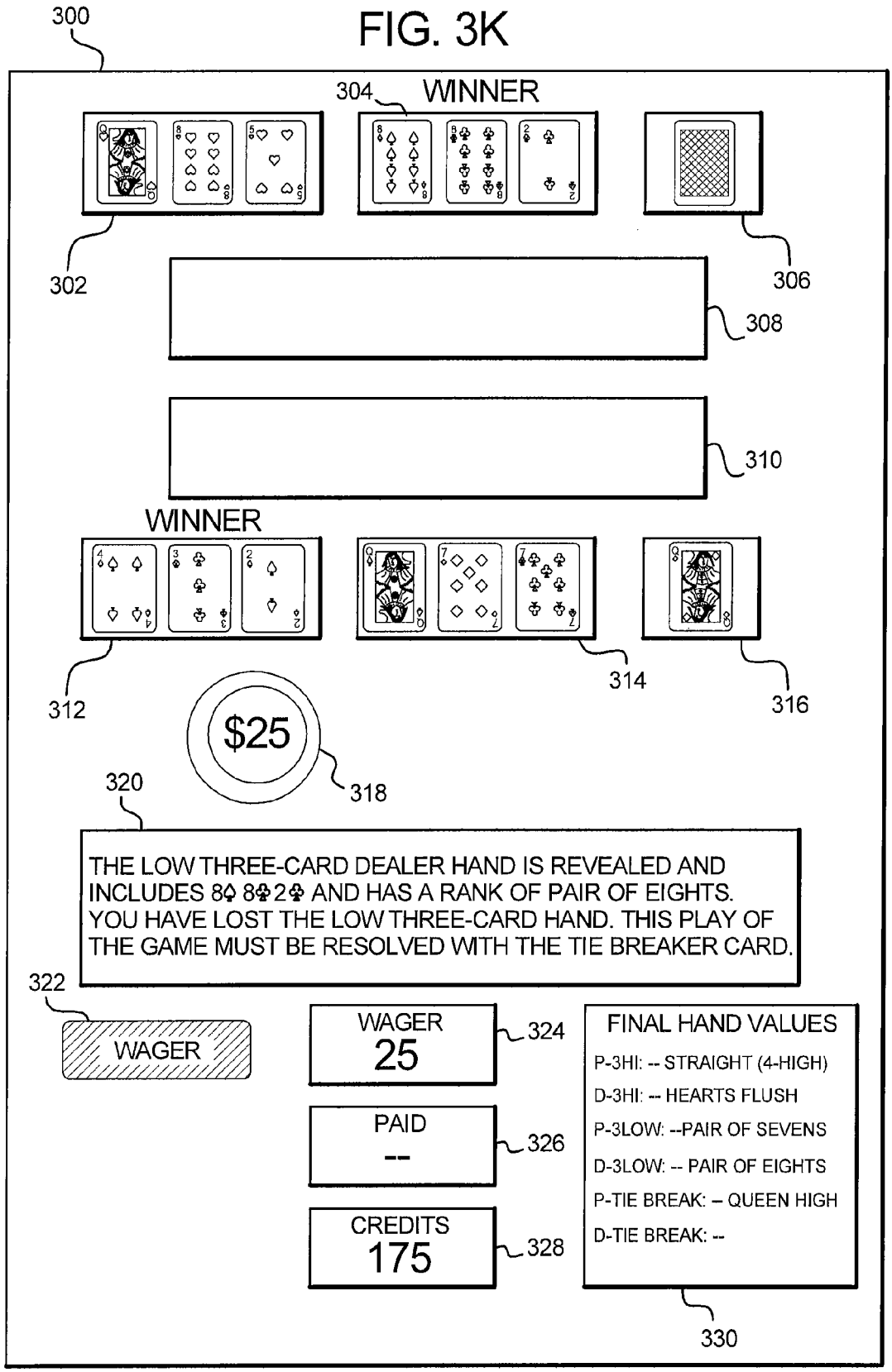

As shown in FIG. 3K, the gaming system 300 causes the cards in the low three-card dealer hand area 304 to be revealed. These cards include the 8♠, 8♣ and the 2♣ as also indicated in message display 320 and the final hand value display 330. Therefore, the rank of the low three-card dealer hand area 304 is a pair of eights and the rank of the low three-card player hand is a pair of sevens. Accordingly, the player loses the low three-card hand, as also indicated in message display 320. Because the player has won one hand and lost one hand, the play of the game must be resolved with the tie-breaker cards 316 and 306. In this example, as described above, if the player had made the decision to use both queens in the low three-card player hand area 314, the low three-card player hand area 314 would have outranked the low three-card dealer hand area 304, and the player would have already won this round of play of the game.

Figure 3L:
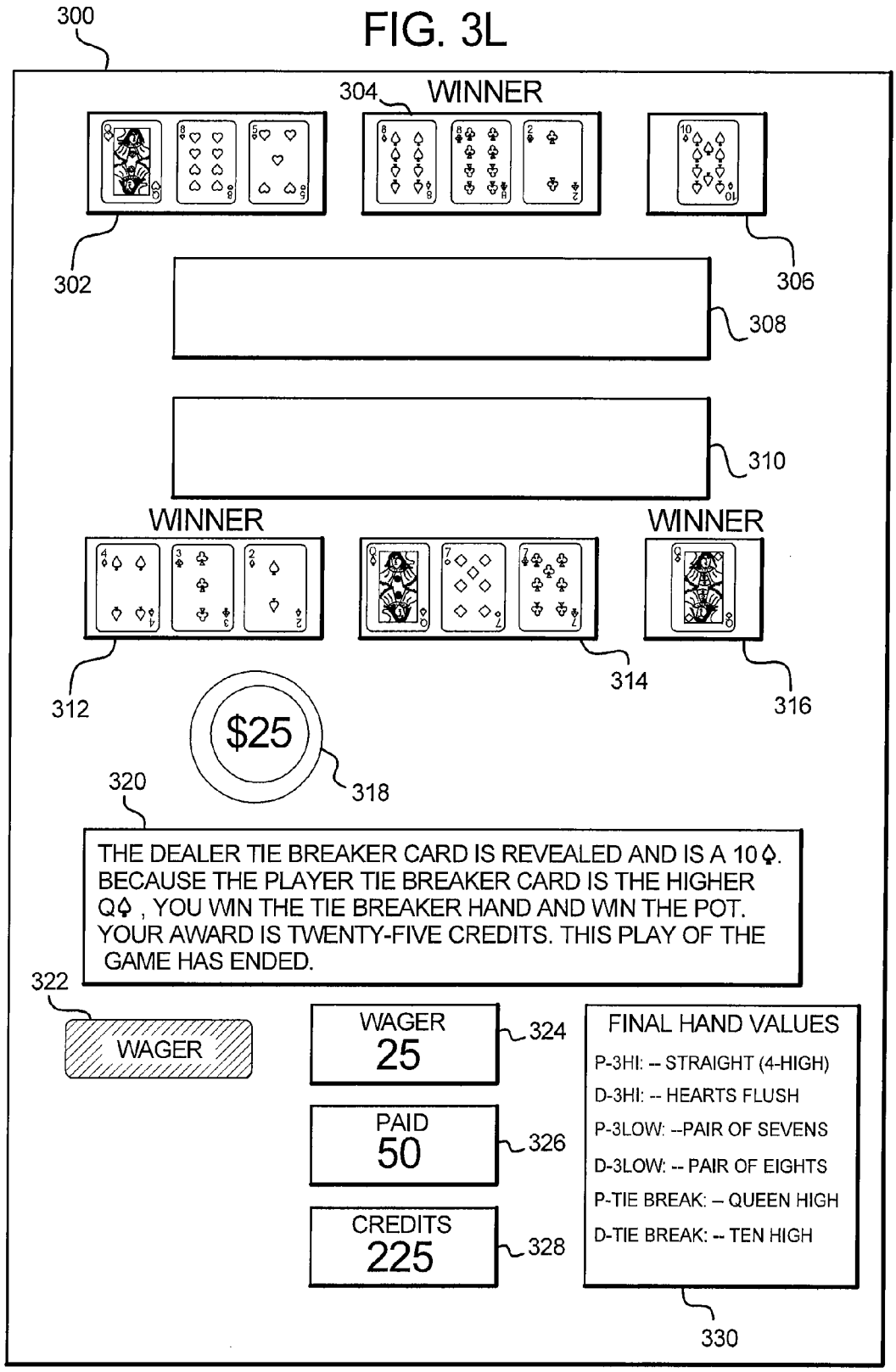

As shown in FIG. 3L, the gaming system causes the dealer tie-breaker card area 306 to be revealed. In this example, the dealer tie-breaker card area 306 is the 10♠, as also indicated in message display 320 and in the final hand value display 330. Because the player tie-breaker card area 316, which is a Q♦ is a higher card than the dealer tie-breaker card area 306, which is a 10♠, the player wins the tie-breaker hand, as also indicated in message display 320. Had the player and the dealer had the same ranking tie-breaker card in this example, this would be a tie game. In one embodiment, the player would receive his or her bet back for such a tie. In another embodiment, the player would lose his or her bet if the player did not win outright against the dealer. In another embodiment, the dealer tie-breaker card must beat the player tie-breaker card in order to beat the player on the play of the game. The gaming system 300 causes an award of twenty-five credits to be provided to the player in addition to returning the players original wager of twenty-five credits, as indicated in the paid display 326 and in the total credits display 328. That is, the total credits display has been increased from one-hundred seventy-five total credits, to two-hundred twenty-five total credits. As indicated in the message display 320, this round of play of the game has ended.

Figure 4A:
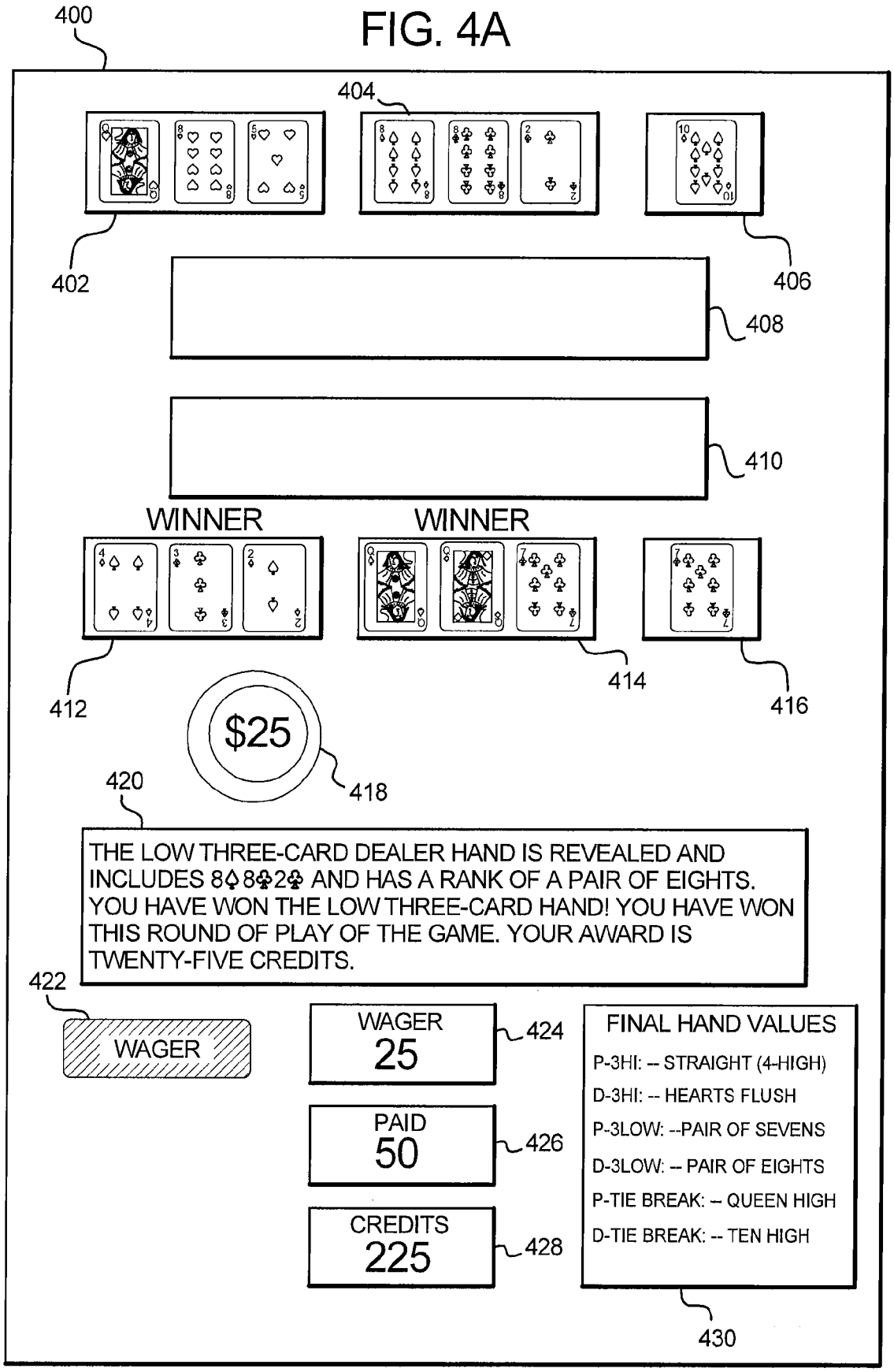
FIG. 4A is an illustration of a screen display for a round of play of the game, where the player and the dealer both have a high three-card poker hand, a low three-card poker hand, and a tie breaker card, and where the player wins both of the three-card hands.

As shown in FIG. 4A, a portion of a round of a play of a game is illustrated where the player wins both the high three-card player hand 412, and the low three-card player hand 414, such that a determination of a high tie-breaker card is not needed. In this example, the three-cards in the high three-card player hand 412 and the cards in the high three-card dealer hand 402 are the same as in the example above with respect to FIGS. 3A through 3L. However, in this example, the cards in the low three-card player hand 414 include the Q♠, Q♦ and 7♣. Also, the three-cards in the low three-card dealer hand 404 include the 8♠, 8♠ and 2♣. Therefore, because the pair of Queens in the low three-card player hand 414 outrank the pair of eights in the low three-card dealer hand 404, the player wins the second hand (i.e., the low three-card hand) as well. As indicated in message display 420, the player has won this round of the game and the gaming system 400 provides the player with an award of twenty-five credits. Even if both three-card player hands had outranked the corresponding dealer hands or if both three-card dealer hands had outranked the corresponding player hands, it would be customary to reveal the dealer's tie card to the player even though it does not need to be considered for determining whether or not the player won. In another embodiment, all of the dealer hands are revealed simultaneously. In another embodiment, the dealer hands are not set until after all player hands have been set. In one variation, the dealer hands are first set and are then revealed one hand at a time. In another variation, all dealer cards are revealed and are then set into their appropriate positions relative to house rules.

in another embodiment, as shown in FIGS. 5A through 5I, both the player and the dealer receive six cards each which are separated into two, three-card hands. As shown in FIG. 5A, the gaming system 500 includes a display that includes several elements. These elements include a high three-card dealer hand 502 and a low three-card dealer hand 504, as well as a high three-card player hand 512 and a low three-card player hand 514. The gaming system 500 also includes a dealer card area 508 and a player card area 510, a message display 520, a wager input 522, a wager display 524, and a paid display 526, a total credits display 528, and a final hand value display 530. In contrast to the embodiment described above with respect to FIGS. 3A to 3J, this embodiment does not include setting a dealer tie-breaker card, or setting a player tie-breaker card.

In a round of play of the game, the gaming system 500 deals six cards that are player cards and six cards that are dealer cards. The player receives the six player cards and separates the six cards into two three-card hands, where the first three-card player hand 512 has a higher rank than the rank of the second three-card player hand 514. Similarly, the gaming system 500 causes three cards to be moved from the dealer card area 508 to the high three-card dealer hand 502, and three cards to be moved to the low three-card dealer hand 504. Similar to the player hands, the rank of the high three-card dealer hand 502 must be greater than or equal to the rank of the low three-card dealer hand 504. After the cards have been moved, all cards including the player cards and the dealer cards are revealed and the hands are evaluated based on standard Three Card Poker rules. If each player hand beats the corresponding dealer hand, the player wins. If each dealer hand beats the corresponding player hand, the player loses. If one player hand beats the corresponding dealer hand, but the other player hand loses to the corresponding dealer hand, it results in a tie.

As shown in FIG. 5A, the gaming system 500 instructs the player to place a wager on a round of play of the game. In this example, the player places a wager of twenty-five credits, as indicated by the activated wager input 522, the twenty-five credit chip or token in the wager area 518, and in the wager display 524. Also, when the player places a wager of twenty-five credits, the gaming system 500 reduces the total number of credits from an original value of two-hundred credits down to the lower value of one-hundred seventy-five credits, as indicated in the total credits display 528.

As shown in FIG. 58, the gaming system 500 deals six cards to the dealer card area 508 and deals six cards to the player card area 510, where all of the cards are initially dealt face-down.

As shown in FIG. 5C, the gaming system 500 selects the third, fourth and fifth dealer cards from the dealer card area 508 and causes the cards to be moved to the high three-card dealer hand 502, as indicated by the dashed outlines in the dealer card area 508 and the directional areas pointing from the dealer card area 508 to the high three-card dealer hand 502. In this embodiment, as discussed above, the three-cards that the gaming device selects to form the high three-card dealer hand 502 must have a higher rank than the remaining three-cards in the dealer card area 508.

As shown in FIG. 5D, the gaming system causes the remaining first, fifth and sixth cards to be moved from the dealer card area 508 to the low three-card dealer hand 504. This is also indicated by the dashed lines and the directional arrows, as discussed above. However, it should be appreciated that in other embodiment, the gaming system may utilize any suitable method of indicating that the cards have been moved from the dealer card area 508 to one of the dealer hands, such as an animation. In this example, the gaming system 500 indicates on the message display 520 that the rank of the high three-card dealer hand is greater than or equal to the rank of the low three-card dealer hand.

As shown in FIG. 5E, the gaming system 500 causes each of the six cards in the player card area 510 to be revealed to the player. The gaming system also directs the player to select three-cards to form the high three-card player hand 512, as also indicated in message display 520.

As shown in FIG. 5F, the player has selected the first, fourth and fifth player cards from the player card area 510 to form the high three-card player hand 512. In this example, the selected cards include the 4♠, 3♣ and 2♠. This hand has a rank of a four high straight, as also indicated in message display and in the final hand value display 530.

As shown in FIG. 5G, the remaining second, third and sixth player cards have been moved from the player card area 510 to the low three-card player hand 514. These three-cards include the Q♠, 7♦ and Q♦. The rank of the low three-card player hand 514 is a pair of sevens, as also indicated by the message display and the final hand value display 530.

As shown in FIG. 5H, the gaming system 500 reveals the values of the cards in the high three-card dealer hand 502. In this example play of the game, these three-cards in the high three-card dealer hand 502 include the Q♥, 8♥ and 5♥. This hand has a rank of a flush. Because the high three-card player hand 512 has a higher rank of a straight, the player wins the high three-card hand, as also indicated in message display 520 and by the winner icon displayed adjacent to the high three-card player hand 512 area.

As shown in FIG. 5I, the gaming system 500 causes the cards in the low three-card dealer hand 504 to be revealed. These three-cards include the 8♠, 8♣ and 2♣. The rank of the low three-card dealer hand 504 is a pair of eights, as indicated in the message display and also in the final hand value award display 530. Because the rank of the low three-card player hand (i.e., a pair of Queens) is higher than the rank of the low three-card dealer hand 504 (i.e., a pair of eights), the player wins this round of play of the game, as indicated in message display 520. The gaming system 500 provides the player with an award of twenty-five credits, as indicated in the paid display 526 and the total credits display 528. That is, as discussed above, the gaming system 500 provides the player with an award of twenty-five credits and refunds the original wager amount of twenty-five credits such that the total credits display has changed from one-hundred seventy-five credits to two-hundred twenty-five credits. This ends this round of play of the game.

With regard to the embodiment shown and described with respect with FIGS. 5A-5I, it should be appreciated that several opportunities exist for the player winning one hand and the dealer winning the other (i.e., the player and the dealer tying for the overall play of the game). In certain embodiments, a push or a tie is resolved by a secondary tie-breaking event. In one embodiment, the gaming system 500 causes a random selection of a seventh card for both the player and the dealer. If the value of the seventh player card is higher than the value of the seventh dealer card, the player wins the round of play of the game and the gaming system 500 provides an award to the player. In contrast, if the value of the seventh dealer card is higher than or equal to the value of the seventh player card, the player loses the original wager amount. It should be appreciated that any suitable method for resolving a tie can be utilized by the gaming system 500. It should also be appreciated that in other embodiments, in the event of a tie, a push or a tie between the player and the dealer would result in the gaming system 500 causing the players original wager amount to be refunded to the player.

In one embodiment, where the game includes two three-card player hands and two three-card dealer hands as discussed above with respect to FIGS. 5A-5I, the gaming device requires the player to make a single wager. However, in other embodiments, the gaming system 500 requires the player to make multiple wagers where one wager is placed on each of the three-card player hands. In this embodiment, the player may win an award on the first hand and may lose an award on the second player hand.

Figure 6A:
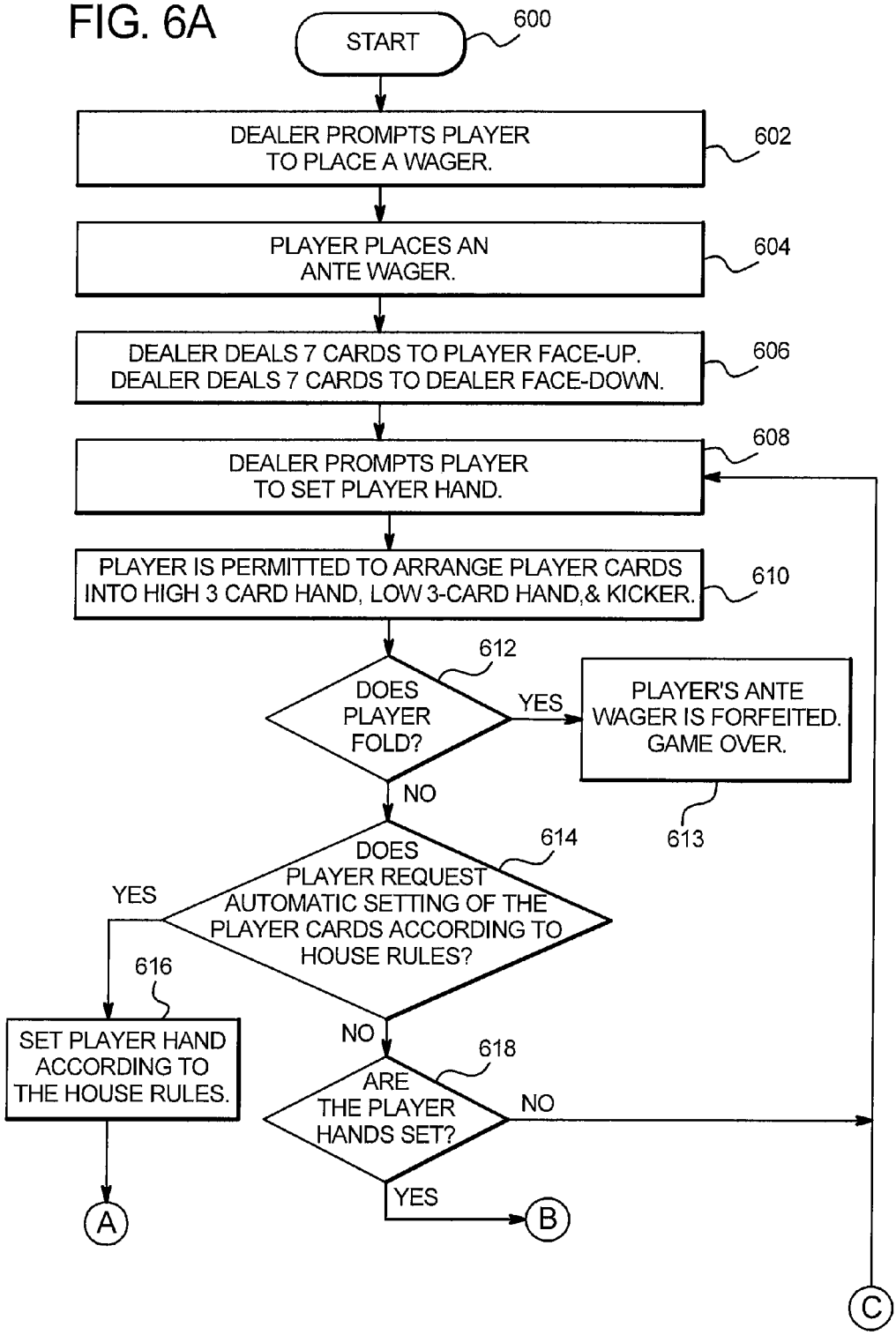
FIGS. 6A, 6B and 6C are schematic diagrams for a round of play of the game.
Figure 6B:
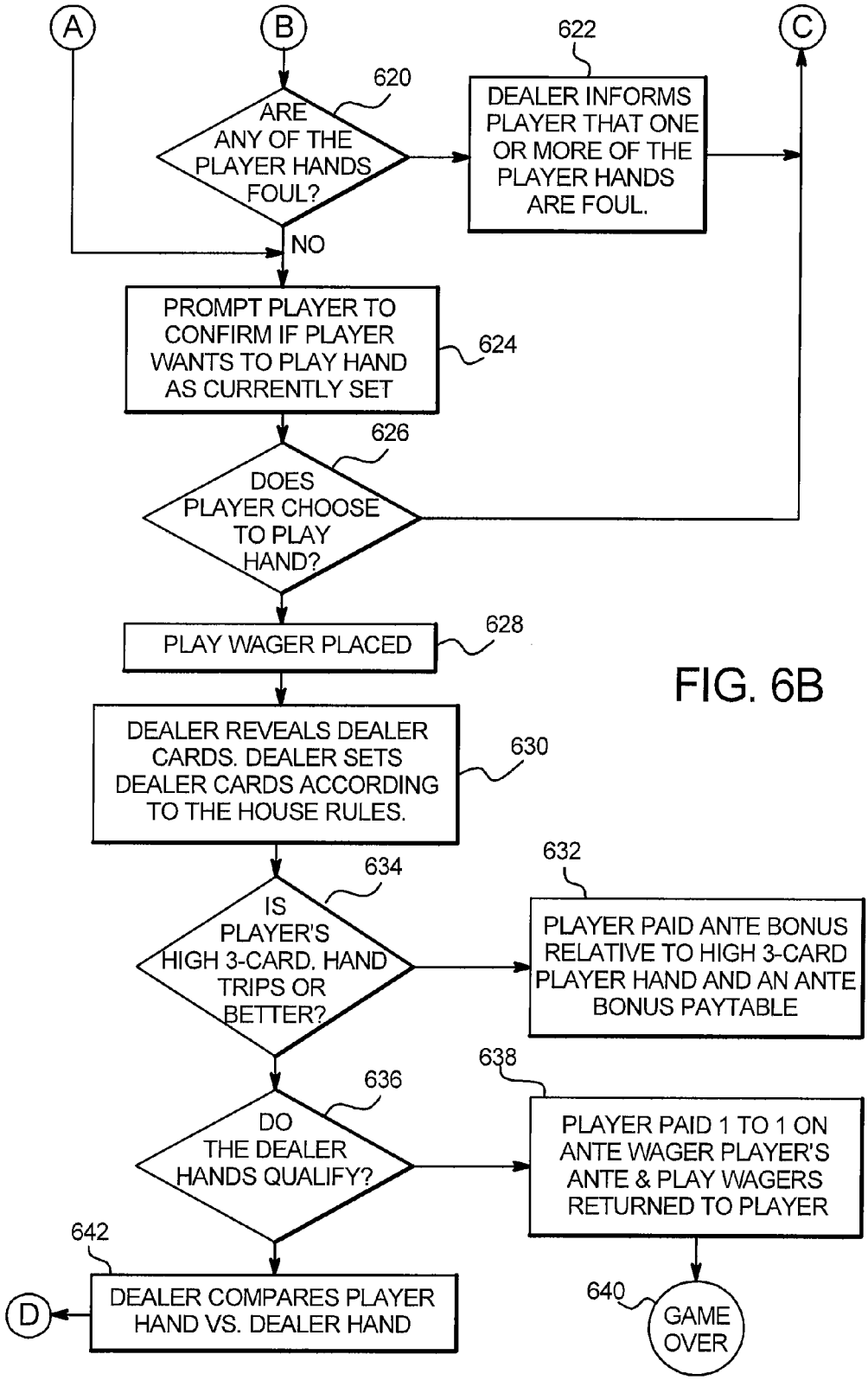
Figure 6C:
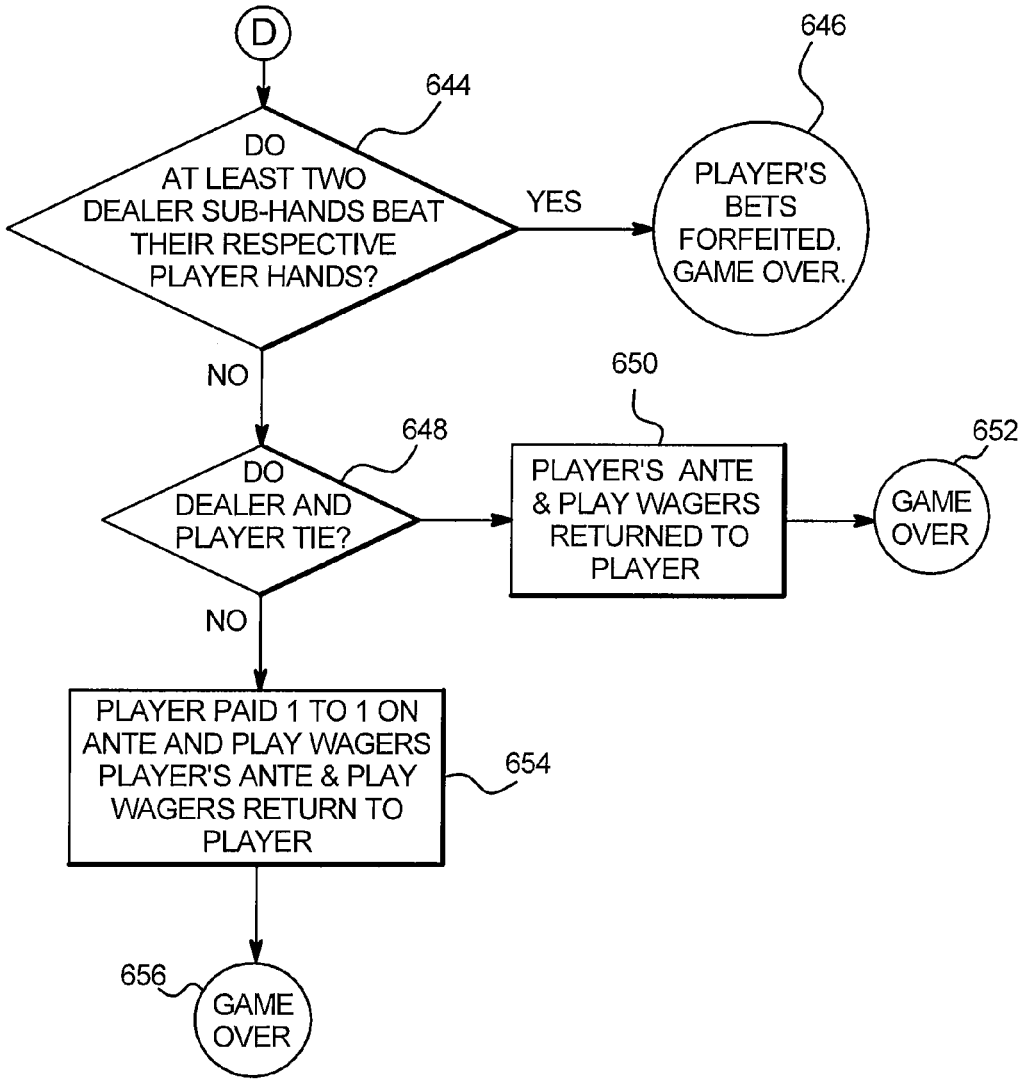

FIGS. 6A to 6C illustrate a general overview of the operation of one example of one embodiment of the gaming system. As illustrated in FIG. 6A, the gaming system initiates a play of the game, as indicated in oval 600. The gaming system enables or prompts a player to make an Ante wager, as indicated by block 602. The gaming system receives or the player places an Ante wager to begin a round of play of the game, as indicated by block 604. The gaming system deals seven cards to the player face-up and deals seven dealer cards face-down, as indicated by block 606. After the player and dealer cards have been dealt, the gaming system prompts the player to set the cards in each of the high three-card player hand, the low three-card player hand, and the kicker card, as indicated by block 08. The gaming system enables the player to set three of the player cards to form the high three-card player hand, three cards to form the low-three card player hand and the player kicker card, as indicated by block 610. The player has the option to fold their hands, as indicated in decision diamond 612. If the player chooses to fold, the player's Ante wager is forfeited and the play of the game is ended, as indicated by oval 613.

The gaming system enables the player to choose whether to set their own hand or have the gaming system set the cards in the player hands according to the house rules, as indicated by decision diamond 614. If the player opts to have the gaming system set the card in the player hand according to house rules, the gaming system sets the player hands, as indicated by block 616. However, if the player opts to set their own hands, the gaming system determines whether the player has already set the cards in the player hands, as indicated by block 618. If the gaming system determines that the player has not yet set the player hands, the gaming system prompts the player to set the player hands, as indicated by block 608.

If the gaming system determines that the player has already set the cards in the player hands, the gaming system must determine if the cards were set properly and in accordance with the house rules. As mentioned above, in certain embodiments, the high three-card player hand must have a rank greater than or equal to the rank of the low-three card player hand, and the low three-card player hand must have a rank greater than or equal to the rank of the player kicker card. Therefore, the gaming system verifies that these conditions are met.

As illustrated in FIG. 6B, the gaming system determines whether any of the player hands are foul (i.e., if the relative rankings of the high three-card player hand, the low-three card player hand, and the player kicker card violate the house rules), as indicated by decision diamond 620. If the gaming system determines that the overall player hand is foul, the gaming system indicates this to the player and prompts the player to reset the cards in the player hands in order to comply with the house rules, as indicated by block 622. It should be appreciated that in another embodiment, if the player sets a hand that is four, the player forfeits their wagers. If the overall player hand is not determined to be foul, the gaming system prompts the player to confirm if the player wants to play the hands as currently set, as indicated by block 624. If the player indicates that they do not want to play the hand with the current card settings, the gaming system prompts the player to reset the cards in the player hand, as indicated by blocks 626 and 608 (in FIG. 6A). If the player indicates that he/she wants to keep the current setting of cards in the player hand, the player places a Play wager, as indicated by block 628. The gaming system causes the seven dealer cards to be revealed and sets the cards in the dealer hands according to the house rules. That is, the gaming system selects three of the seven total dealer cards to form the high three-card dealer hand, selects three of the remaining four cards to form the low-three card dealer hand, and selects the final card to be the dealer kicker card. According to the house rules, the gaming system sets the dealer hands such that the rank of the high three-card dealer hand is greater than or equal to the rank of the low three-card dealer hand, and such that the rank of the low three-card dealer hand is greater than or equal to the rank of the dealer kicker card.

In the example illustrated in FIG. 6B, the gaming system determines if the high three-card player hand has a rank greater than or equal to a Three Of A Kind, as indicated by decision diamond 634. If the rank of the high three-card player hand is greater than or equal to a Three-Of-A-Kind, the gaming system provides the player an Ante bonus according to an Ante bonus payable, as indicated by block 632. In this example, the gaming system provides an Ante bonus award regardless of the relative ranking of player and dealer hands and regardless of whether or not the dealer qualifies. In other embodiments, the gaming system provides an Ante bonus award depending upon a relative ranking of the player and dealer hands and/or whether or not the dealer hand qualifies. In another embodiment, there is no Ante bonus award. If the player does not have a high enough of a bonus qualifying hand, the gaming system does not provide the player with the Ante bonus award.

Referring still to FIG. 6B, the gaming system determines if the overall dealer hand meets a qualifying condition, as indicated by decision diamond 636. In one embodiment, the qualifying condition for the overall dealer hand is that the rank of the high three-card dealer hand is greater than or equal to a predetermined rank, such as being a straight or better. In another embodiment, the qualifying condition for the overall dealer hand is that the ranks of both the high and low three-card dealer hands must be greater than or equal to a predetermined rank. In another embodiment, the qualifying condition for the overall dealer hand is that the rank of the low three-card dealer hand must be greater than or equal to a predetermined rank, such as being a King high or better, while still meeting the criteria that the low three-card dealer hand has a lesser or equal rank relative to the high-three card dealer hand. It should be appreciated that any suitable dealer qualifying condition or conditions may be used. If the gaming system determines that the dealer hands do not qualify, the gaming system pays the player 1:1 on the Ante wager and both the Ante wager and Play wager are returned to the player, as indicated by block 638. If the dealer hands do not qualify, the round of play of the game ends, as indicated by oval 640. If the dealer hand meets the qualifying condition, the gaming system compares the player hands to the dealer hands to determine the overall winner, as indicated by block 642. That is, the gaming system determines: (a) if the high three-card player hand beats the high-three card dealer hand; (b) if the low three-card dealer hand beats the low-three card dealer hand; and (c) if the player kicker card beats the dealer kicker cards.

As illustrated in FIG. 6C, the gaming system determines the total number of winning player hands, as indicated by decision diamond 644. If the total number of winning dealer hands is at least two, the player's Ante wager and Play wager are forfeited and the round of play of the game ends, as indicated by oval 646. If the gaming system determines that less than two of the dealer hands are winning hands, the gaming system determines if the player and the dealer have tied, as indicated in decision diamond 648. For example, if the high three-card player hand wins, the low three-card dealer hand wins, and the player and dealer kicker cards are the same value, the player and dealer tie. If the player and the dealer tie, the gaming system returns both the Ante wager and the Play wager to the player and the game ends, as indicated by block 650 and oval 652. If the dealer has less than two winning hands and the player and dealer did not tie, then the player wins the overall play of the game, as indicated by block 654. If the player wins the overall play of the game, the gaming system pays the player 1:1 on both the Ante wager and the Play wager, and returns the Ante wager and Play wager to the player, as indicated by block 654. The round of play of the game ends, as indicated in oval 656.

As mentioned above, in certain embodiments, house rules determine the setting of the cards in the dealer hand (and possibly the player hand). In one embodiment, as illustrated in FIG. 7, the house rules include a set of logical steps to determine how to set the cards in the three dealer hands. In one embodiment, these logical steps may be employed by a live dealer at a gaming table. In another embodiment, these logical steps may be employed by a live dealer at a gaming table where the gaming system includes a computer program having logic for setting the cards. In this embodiment, the gaming system includes at least one processor that executes the computer program and causes instructions to be indicated to the live dealer regarding how to set the cards in the dealer hands.

Referring now to FIG. 7, in one embodiment, at block 702 seven dealer cards have already been dealt. As described above with respect to Table 2, there are generally seven rankings for Three Card Poker hands (i.e., from highest to lowest rank, these ranking include a Royal Straight Flush, a Straight Flush, a Three Of A Kind, a Straight, a Flush, One Pair and High Card). The gaming system includes a computer program having a looping logic that sequentially checks, for each of the seven types of Three Card Poker hand rankings, the seven dealer cards to determine if a three-card dealer hand can be with the respective rank. The gaming system starts with the highest ranking Three Card Poker hand (i.e., in this particular embodiment this is the Straight Flush), as indicated by block 702. The gaming system determines whether this is the lowest hand type (e.g., High Card or No Pair), as indicated by decision diamond 704. If this is not the lowest ranking hand type, then the gaming system determines if a high three-card dealer hand of this particular rank type can be formed from the seven available dealer cards, as indicated by decision diamond 708. If a three-card hand of this rank type can not be formed from the seven dealer cards, then the gaming system selects the next lowest ranking Three Card Poker rank type (i.e., a Three Of A Kind), as indicated by block 710. The gaming system continues with this looping logic until the a high three-card dealer hand (i.e., BIG3) can be formed from the seven available dealer cards, as indicated by block 708. If the gaming system has looped through the logic enough times that the current hand type is the lowest ranking hand type (e.g., high card), then the dealer hand has not met the dealer qualifying condition. It should be appreciated that the dealer qualifying condition could be that the seven dealer cards must be capable of forming at least a pair, or a flush or any other suitable minimum ranking type.

If the gaming system determines that a high three-card hand can be formed from the current rank type (e.g., if the current hand type is the rank type of Three Of A Kind, and the seven dealer cards include 5♥ K♠7♠5♦ 5♣A♦10♠), then the gaming system determines if two sub hands (i.e., the high three-card dealer hand and the low three-card dealer hand) can be formed with the same rank (i.e., two Three Of a Kind hands), as indicated in decision diamond 712. If two hands can be formed of the same general rank type (e.g., 5♦ 7♠5♥ 5♠A♣7♣7♥ are able to form two Three Of A Kind hands), the gaming system determines if the hands are qualifying hands, as indicated by decision diamond 714. IT the hands are not qualifying hands, the gaming system selects the next lowest hand type and continues the looping procedure, as indicated by block 710. However, if the two same ranking dealer hands are qualifying hands, then the gaming system sets the high three-card hand (i.e., BIG3) with the higher valued hand (for the particular rank type) and sets the low three-card hand (i.e., LIL3) with the lower valued hand. In this example given above, the gaming system would set the high three-card dealer hand (i.e., BIG3) to include the 7♣7♣ 7♥, the low three-card dealer hand (i.e., LIL3) to include the 5♥ 5♦ 5♣, and the dealer kicker card would be the remaining A♣, as indicated by block 716. Under this scenario, the dealer hand would be set, as indicated by oval 718.

Referring still to FIG. 7, if only one subhand (i.e., a three-card hand) of the current three-card rank type can be formed, then the gaming system sets the high-three card dealer hand with three of the seven dealer cards to form the high three-card dealer hand of the current rank type using the lowest value cards (e.g., the lowest possible Straight of the list A-K-Q, 3-2-A, K-Q-J, Q-J-T, J-T-9, T-9-8, 9-8-7, 8-7-6, 7-6-5, 6-5-4, 5-4-3, 4-3-2, if more than one possible Straight can be formed from the seven dealer cards), as indicated by block 720. The gaming system determines if a qualifying hand can be formed from the three selected dealer cards, as indicated by block 722. If a qualifying high three-card dealer hand can be formed, then the gaming system selects three of the remaining four dealer cards to form the highest rank type low three-card dealer hand possible, as indicated by block 724.

Also: the gaming system selects the low three-card dealer hand so as to maximize the value of the kicker without reducing the rank type, as indicated by block. For example, in the case where the four cards remaining after the high three-card hand is set are Q♥ J♥ 5♥ 2♥, the low three-card hand would be set to include J♥ 5♥ 2♥ thereby setting the Q♥ as the kicker. Even though Q♥ J♥ 5♥ would have formed a stronger low three-card hand, the highest card out of the four card is set to be the kicker hand such that the low three-card hand is still able to attain the highest rank-type possible (which in this example is a flush.) The remaining dealer card is set to be the dealer kicker card and the dealer hand is set, as indicated by oval 728.

If however, a qualifying high three-card dealer hand is not formed, the gaming system determines if a higher ranking three-card hand of the same three-card poker rank type can be formed, as indicated by decision diamond 730. In one example, the dealer qualifying condition is that the high-three card dealer hand must have a minimum rank of One Pair and the pair must be a pair of Queens or higher. In this example, if the seven dealer cards include the 6♦ K♦ 7♣4♥ 6♥K♣2♥, and the current rank type in the looping logic is One Pair, then the gaming system first determines the lowest pair, which is the pair of sixes, as indicated also in decision diamond 720. However, the pair of sixes is not a qualifying hand according to the example dealer qualifying condition mentioned above. Therefore, the gaming device determines if there is a higher ranking high three-card dealer hand of the same rank type (i.e., One Pair) that can be formed, as indicated in decision diamond 730. In this example, the K♣ and K♦ form a higher ranking hand of the same rank type The gaming device selects these two cards and one additional dealer card to form the high three-card dealer hand, and again determines if this dealer hand meets the dealer qualifying condition, as indicated in step 732 and in decision diamond 722. If no higher ranking high three-card dealer hand can be formed, then the gaming system selects the next lowest hand type and continues the looping logic discussed above, as also indicated by block 710. If a qualifying hand can be formed (see, decision diamond 722), then the gaming device selects the cards to form the low three-card dealer hand and selects the dealer kicker card as described above with respect to blocks 724, 726 and by oval 728.

In another embodiment, the dealer qualifying rules require that the dealer's low three-card hand be formed to have an Ace high outcome or better. In an example where the dealer cards include A♥ K♥ Q♣ 8♣2♠ 3♥, the dealer first verifies that a three-card Straight Flush or a Three-Of-A-Kind cannot be formed. However, the next lowest hand rank-type, a Straight, can be formed. In this example, there are two possibilities for a Straight: A♥ K♥ Q♣, or A♥ 2♣3♥. The latter straight is preferred since it uses fewer high cards. Selecting A♥ 2♣3♥ for the high three-card hand leaves the four cards K♥ Q♣ 8♠ 8♥ available for the remaining low three-card dealer hand. A qualifying low three-card dealer hand can be formed from these four cards, namely a pair of eights. There are two ways of setting these four cards to achieve the qualifying pair of eights, (a) using 8♠8♥ K♥, with a Q♣ as a kicker card; or (b) using 8♣ 8♥ Q♣ with a K♥ as the kicker. The latter choice maximizes the kicker value while maintaining the highest possible low three card rank type. Therefore, the final hands setting for high three-card dealer hand, the low three-card dealer hand, and the dealer kicker hand would be: A♥ 2♠3♥, 8♣ 8♥ Q♣; and K♥.

Figure 8:
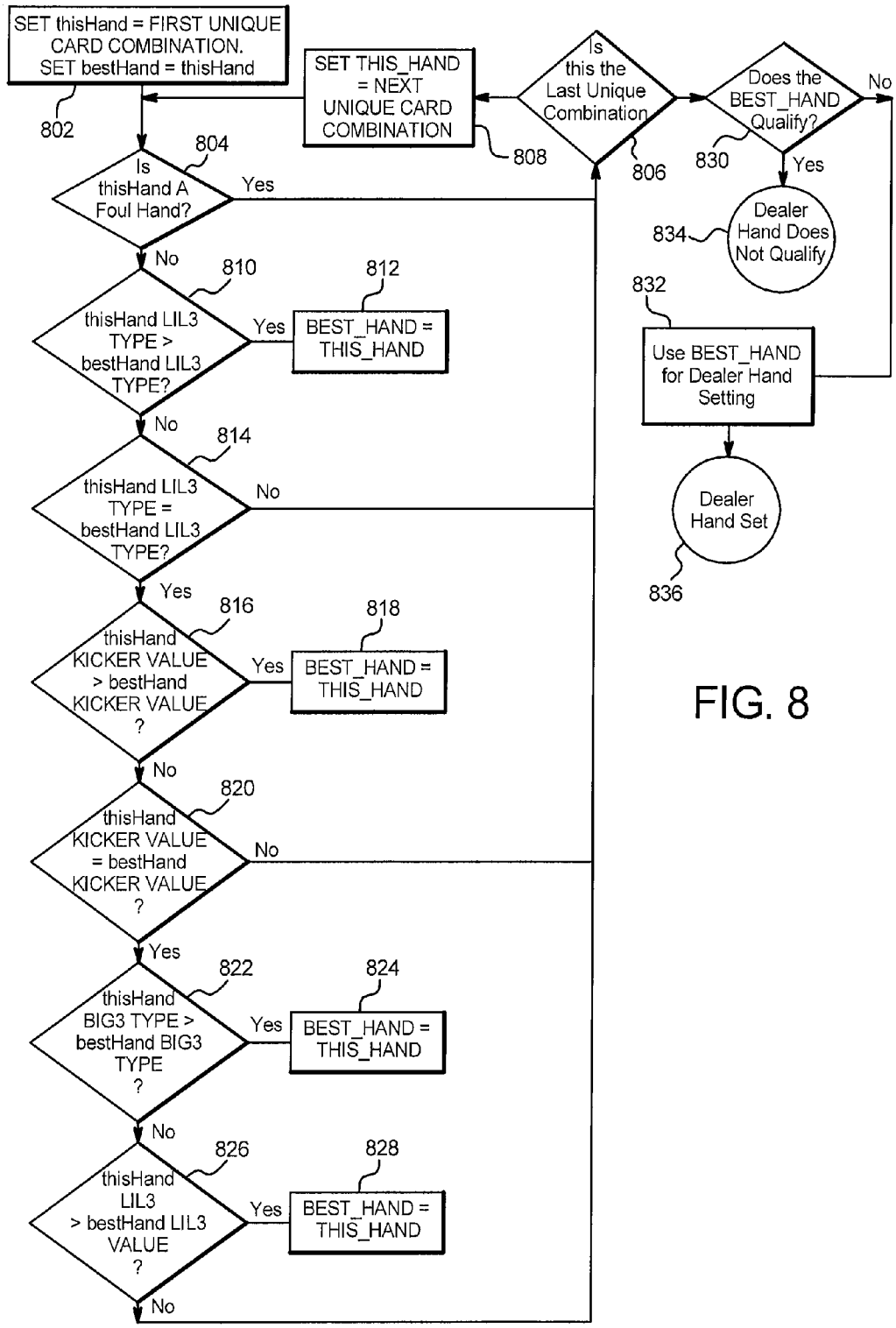
FIG. 8 is a schematic diagram illustrating an example of dealer hand setting logic, in an embodiment.

In one embodiment, as shown in FIG. 8, the gaming system includes a computer program that includes logic for setting the high three-card dealer hand (i.e., BIG3), the low three-card dealer hand (i.e., LIL3) and the dealer kicker card, based at least in part, by considering all of the unique seven-cards combinations that can be formed from the set of seven dealer cards. At the beginning of this process, the gaming system sets a variable named thisHand equal to the entire first unique seven-card card combination. In one embodiment, for each unique combination of cards, the seven cards are arranged in seven card positions, where the cards in positions one, two and three correspond to the cards in the high three-card dealer hand (i.e., BIG3), where the cards in positions four, five and six correspond to the cards in the low three-card dealer hand (i.e., LIL3), and the card in position seven corresponds to the dealer kicker card. For each unique card combination, the gaming system evaluates a rank of the BIG3, LIL3, and the kicker to determine if the seven card combination is a foul combination (i.e., a foul seven card combination is where the conditions are not met that: (a) the rank of the BIG3 hand is greater than or equal to the rank of the LIL3 hand; and (b) the rank of the LIL3 hand is greater than or equal to the rank of the kicker). Thus, the gaming system is able to filter out from the entire pool of unique combinations of seven cards, only those combinations that do not result in a foul hand. Accordingly, a smaller number of combinations of cards must be fully considered to determine whether they form the optimal result for the dealer. As mentioned above, the variable thisHand represents all seven of the dealer cards, in a particular combination. Several variables are also defined that are related to the thisHand variable. The variable $thisHand_{LIL3\text{-}TYPE}$ represents the type of rank of the fourth, fifth and sixth cards in the current combination of seven cards (e.g., if the third, fourth and fifth cards include J♥5♥10♥, then $thisHand_{LIL3\text{-}TYPE}$ would be equal to a Flush). The variable $thisHand_{BIG\text{-}TYPE}$ represents the type of rank of the first, second and third cards in the current combination of seven cards (e.g., if the first, second and third cards include 2♠5♥2♥, then $thisHand_{BIG3\text{-}TYPE}$ would be equal to One Pair). Similarly, the variable $thisHand_{KICKER\text{-}VALUE}$ represents the value of the card in the seventh card position. Another set of variables represent the best seven card combination that has been yet considered by the gaming system. These variables include bestHand (all seven cards), $bestHand_{LIL3\text{-}TYPE}$ (cards in the fourth, fifth and sixth card positions), $bestHand_{BIG3\text{-}TYPE}$ (cards in the first, second and third card positions), and $bestHand_{KICKER\text{-}VALUE}$ (the card in the seventh card position). The gaming system initially sets the bestHand variable equal to the thisHand variable, as indicated by block 802. However, when the gaming system determines that another non-foul combination of seven cards has a better overall rank than the bestHand, the gaming system overwrites the bestHand variable with the current thisHand variable. Accordingly, the bestHand variable stores the highest ranking analyzed seven card combination.

Referring still to FIG. 8, the gaming system analyzes the first unique seven card combination and sets the thisHand variable equal to this first seven card combination, as indicated by block 802. Also, because this is the first of the seven card combinations to be considered, the gaming system sets the variable bestHand equal to the variable thisHand, as also indicated by block 802. Accordingly, the $bestHand_{LIL3\text{-}TYPE}$, $bestHand_{BIG3\text{-}TYPE}$, and $bestHand_{KICKER\text{-}VALUE}$ variables are also initially set to be the types/values corresponding to the cards in the fourth-fifth-sixth card positions, first-second-third card positions, and seventh card position, respectively The gaming system determines if the variable thisHand (i.e., the current seven card combination) is a foul hand, as indicated by block 804. If the variable thisHand (by block 804) is a foul hand, the gaming system eliminates or filters out the current seven card combination as a possible bestHand, as discussed above. The gaming system then determines if thisHand is the last unique seven card combination, as indicated by decision diamond 806. If the current card combination is not the last unique card combination, the gaming system overwrites the thisHand variable to be equal to the next unique card combination, as indicated by block 808. Therefore, the computer program includes logic to reset the variable thisHand for each of the unique seven-card combinations.

Referring further to FIG. 8, the gaming system determines, for each consecutive non-foul hand, whether the $thisHand_{LIL3\text{-}TYPE}$ variable is greater than the $bestHand_{LIL3\text{-}TYPE}$ variable, as indicated by block 810. If the $thisHand_{LIL3\text{-}TYPE}$ variable is greater than the $bestHand_{LIL3\text{-}TYPE}$ variable, then the gaming device sets bestHand equal to thisHand, as indicated by block 812. As mentioned above, when the bestHand variable is overwritten with the current thisHand variable, each of the $bestHand_{LIL3\text{-}TYPE}$, $bestHand_{LIL3\text{-}TYPE}$, and $bestHand_{KICKER\text{-}VALUE}$ variables (or sub-variables) are also overwritten. If the $thisHand_{LIL3\text{-}TYPE}$ variable is less than the $bestHand_{LIL3\text{-}TYPE}$ variable, then the gaming system does not consider the $thisHand_{BIG3\text{-}TYPE}$ or $thisHand_{KICKER\text{-}VALUE}$, as indicated by decision diamond 814. In this circumstance, the gaming system determines if there is another unique seven card combination to consider, as indicated by block 806. If the $thisHand_{LIL3\text{-}TYPE}$ variable is equal to the $bestHand_{LIL3\text{-}TYPE}$ variable, then the gaming system next considers the value of the current dealer kicker card, as indicated by block 816. If the value of the $thisHand_{KICKER\text{-}VALUE}$ is greater than the value of the $bestHand_{KICKER\text{-}VALUE}$, then the gaming system causes the bestHand variable to be set equal to the thisHand variable, as indicated by block 818. Accordingly, in order for the bestHand variable to be reset based on the value of the dealer kicker card, the gaming system must have previously determined that the value of the $thisHand_{LIL3\text{-}TYPE}$ variable must be equal to but not greater than the $bestHand_{LIL3\text{-}TYPE}$ variable.

Referring further to FIG. 8, if the value of the $thisHand_{KICKER\text{-}VALUE}$ is not greater than the value of the $bestHand_{KICKER\text{-}VALUE}$, then the gaming system determines whether the $thisHand_{KICKER\text{-}VALUE}$ variable is equal to the value of the $bestHand_{KICKER\text{-}VALUE}$, as indicated by block 820. If the gaming system determines that value of the $thisHand_{KICKER\text{-}VALUE}$ variable is less than the value of the $bestHand_{KICKER\text{-}VALUE}$, the gaming system eliminates or fitters out the current seven card combination as a possible bestHand, as discussed above. The gaming system then determines if thisHand is the last unique seven card combination, as indicated by decision diamond 806. If the current card combination is not the last unique card combination, the gaming system overwrites the thisHand variable to be equal to the next unique card combination, as indicated by block 808. However, if the gaming system determines that the $thisHand_{KICKER\text{-}VALUE}$ variable is equal to the value of the $bestHand_{KICKER\text{-}VALUE}$, then the gaming system considers the value or rank of the high three-card dealer hand (i.e., BIG3), as indicated by block 822. Accordingly, in order for the gaming system to consider the BIG3 hand, the gaming system would have had to previously determine that the value of the $thisHand_{LIL3\text{-}TYPE}$ variable is equal to but not greater than the $bestHand_{LIL3\text{-}TYPE}$ variable, and determine that the value of the $thisHand_{KICKER\text{-}VALUE}$ variable is equal to but not greater than the $bestHand_{KICKER\text{-}VALUE}$.

Referring further to FIG. 8S if the value of the $thisHand_{LIL3\text{-}TYPE}$ variable is equal to but not greater than the $bestHand_{LIL3\text{-}TYPE}$ variable, and if the value of the $thisHand_{KICKER\text{-}VALUE}$ variable is equal to but not greater than the $bestHand_{KICKER\text{-}VALUE}$, the gaming system determines whether the value of the $thisHand_{BIG3\text{-}TYPE}$ variable is greater than the value of the $thisHands_{BIG3\text{-}TYPE}$ variable, as indicated by block 822. If the gaming system determines that the value of the $thisHand_{BIG3\text{-}TYPE}$ variable is greater than the value of the $thisHand_{BIG3\text{-}TYPE}$ variable, then the gaming system sets the value of the bestHand variable equal to the thisHand variable, as indicated by block 824.

However, if the gaming system determines that the value of the $thisHand_{BIG3\text{-}TYPE}$ variable is not greater than the value of the $thisHand_{BIG3\text{-}TYPE}$ variable, then the gaming system determines if the value of the $thisHand_{LIL3\text{-}VALUE}$ variable is greater than the value of the $thisHand_{LIL3\text{-}VALUE}$ (whereas the LIL3-TYPE variable referred to the type of the rank of the LIL3 hand such as One Pair, the LIL3-VALUE variable refers specifically to the value of the One Pair hand such as a pair of Jacks), as indicated by block 826. Accordingly, at this step, because the gaming system has already determined that the $thisHand_{BIG3\text{-}TYPE}$ variable is equal to the value of the $thisHand_{BIG3\text{-}TYPE}$ variable and that the $thisHand_{LIL3\text{-}TYPE}$ variable is equal to the value of the $thisHand_{LIL3\text{-}TYPE}$ variable, the gaming system determines whether to replace a tower valued LIL3 hand with a higher valued LIL3 hand. If the value of the $thisHand_{LIL3\text{-}VALUE}$ variable is greater than the value of the $bestHand_{LIL3\text{-}VALUE}$, the gaming system sets the value of the bestHand variable equal to the value of the thisHand variable, as indicated by block 828.

Referring still to FIG. 8, if the gaming system determines by block 806 that the current unique combination is the final unique seven card combination, then the gaming system determines if the bestHand qualifies, as indicated by block 830. In one embodiment, a dealer hand qualifies if it is not a foul hand, and if the ranking of the low three-card hand is a King high or better. In another embodiment, a dealer hand qualifies if it is not a foul hand, and if the ranking of the low three-card hand is an Ace high or better. However, there are numerous possible qualifying rules that can involve a minimum rank threshold for the high three-card dealer hand, and/or the low three-card dealer hand, and/or the dealer tie breaker card. If the gaming system determines that the bestHand is foul, then the dealer hand does not qualify, as indicated by oval 834. If the gaming system determines that the bestHand variable does not qualify, then the gaming system uses the bestHand for the dealer hand setting, as indicated by block 832. The dealer hand is then set, as indicated by oval 836.

In one example hand, A♣K♠K♣5♣6♦4♦3♦, the hands are set differently when implementing the algorithm depicted in FIG. 7 than when implementing the algorithm depicted in FIG. 8. The former algorithm, which focuses on maximizing the high three-card hand rank type, would result in a setting of 5♣6♦4♦, K♠K♣3♦, and A♣ for high three-card hand, low three-card hand, and kicker card. The latter algorithm, that focuses on maximizing the low three-card hand type, would result in a setting of A♣K♣5♣6♦ 4♦ 3♦, and K♠ for high three-card hand, low three-card hand, and kicker card.

In one embodiment, a player may place an optional, but not required wager, as a side bet wager. In this embodiment, a player may receive a bonus award with regard to the optional side wager if the outcome of either the high three-card player hand or the low three-card player hand is one of several predetermined outcomes. For example, if the rank of the three-card player hand is of a sufficiently high rank, the gaming system provides the player with a bonus award according to a payable. In another example, the optional side wager functions as an insurance wager that protects the player from a particularly frustrating loss to the dealer. For example, if the player achieves a sufficiently high rank on the high three-card player hand, but the dealer achieves an even higher rank, then the player would win a bonus award or an insurance award based on the optional side wager or insurance wager. In one variation of said insurance bonus award, the player is paid a small award when the player achieves a sufficiently high rank on the high three-card player hand and manages to beats the dealer overall.

In one embodiment, where the player and dealer receive seven cards that are divided into a first three-card player hand, a second three-card player hand, and a seventh tie breaker card, an optional side wager may be placed. Awards may be provided to the player based on the optional side wager if the combined seven cards in the player hand have a best five card ranking according to a seven card stud payable. For example, if the seven player cards include four Aces and three other cards, the four Aces may be of a sufficiently high rank on the seven card stud payable for the player to receive an award. In another embodiment, a side bet wager pays relative to a six card or seven card result involving the players seven cards. An example bonus award condition is if the player's cards include three pairs, such as A♣ A♦ K♣ K♠ 5♣ 5♦. Other examples include a seven card Straight-Flush, a seven card Straight, a seven card Flush, six card Straight Flush, a six card Straight, a six card Flush. In one embodiment, one or more bonus events can cause the gaming system to pay the player a progressive award.

In other embodiments, a variety of methods may be utilized to determine setting of the card into the player hands and the dealer hands. In one example embodiment, the player must set the player cards first. Then the gaming system sets the dealer cards with knowledge of the values of one or more of the cards in the first three-card player hand. Accordingly, in this embodiment, the gaming system has an advantage over the player because the gaming system is able to take into account the values of certain of the player cards when making a decision to set the cards in the dealer hands.

In one embodiment, the player is paid on a sufficiently high-ranking three-card hand, even if the player did not place an optional side wager. For example, if the player achieves a Royal Straight Flush (i.e., A♥K♥Q♥) for one of the three-card player hands, the gaming system provides the player with an award according to a payable. In this embodiment, if the player achieves a very high ranking hand, the player wins a bonus award (e.g., 5× the amount wagered on).

In one seven card embodiment that includes the high three-card hands, the low three-card hands, and the tie breaker card, the gaming system sets the cards in the dealer hands according to instructions stored in a computer program. In one such embodiment, the gaming system sets the cards in the dealer hands based on knowledge of the player's cards. In one embodiment, the gaming system sets the cards in the dealer hands by maximizing the rank type of the low three-card dealer hand while still satisfying the rule that the high three-card dealer hand must rank higher than the low three-card dealer hand, in one embodiment, the gaming system sets the cards in the dealer hands by maximizing the rank type of the high three-card dealer hand while still satisfying the rule that the high three-card dealer hand must rank higher than the low three-card dealer hand.

In one embodiment, the gaming device analyses and sets the cards in the dealer hands according to instructions stored in a computer program and also performs a similar analysis on the player cards. The gaming system indicated to the player the cards that could move to the first and second player hands according to a particular card setting strategy. The player has the option of utilizing the gaming systems recommended player card setting strategy, or rejecting this setting strategy and setting the player cards on their own. In another embodiment, the gaming system would automatically set the cards in the player hand according to a defined card setting strategy.

Certain embodiments include a multi-stage wagering arrangement. In one such embodiment, the player places an initial wager, called an Ante wager, to commence a round of play of the game. After placing the Ante wager, the gaming system deals the player cards to the player. After seeing his or her cards, if the player wishes to continue in the game, the player is required to place an additional wager, called a Play wager. The Play wager is set to be of a certain size relative to the Ante wager, such as exactly equal to the Ante wager or exactly twice the value of the Ante wager, based upon the specific game rules. If the player declines to place a Play wager, the player forfeits his or her Ante wager and the game is concluded for that player. In this embodiment, the dealer must meet a set of qualifying rules with regard to the dealer hands. In one example, the rank of the high three-card dealer hand must be of a sufficiently high rank, as in traditional Three-Card Poker rules, as discussed above. In one example, the dealer's low three-card hand must be a King high or better to qualify. In another embodiment, both the rank of the high three-card dealer hand and the rank of the low three-card dealer hand must be of a qualifying rank. In another example, the rank of the high three-card hand and the value of the dealer tie breaker card must be of a sufficiently high rank. In one embodiment, if the player has placed an Ante wager and a Play wager and the dealer hand does not qualify, the player will receive a 1 to 1 pay on the Ante wager and have both the Ante wager and Player wager returned.

In another embodiment, the Play wager amount may be of a range of specified values, such as being of any value between exactly the value of the Ante wager, up to exactly the value of three times the Ante wager. In another embodiment, the Play wager is to be placed after the player sees a number of player cards less than the total number of player cards. In another embodiment, the Play wager is optional. Therefore, after seeing certain specified number of player cards, the player is able to increase his or her wager relative to his or her Ante wager up to a limit specified by the game rules.

In other embodiments, the player can place a side wager that pays a bonus award depending on the outcome of a particular one of the players hands or the dealer's hands. In one such embodiment, the player receives a bonus award depending on the rank of the high three-card player hand. In another embodiment, the player receives a bonus award depending on the rank of the low three-card player hand. In another embodiment, the player can receive multiple bonus awards depending on the ranks of the both of the three-card player hands. For example, if the high three-card player hand is a Royal Straight Flush and the low three-car player hand is a Three-Of-A-Kind, the player receives two bonus awards. In another embodiment, the player receives a larger or enhanced bonus award if both of the player hands include high ranking hands. That is, the player would receive a larger bonus award than would normally be associated with the sum of individual bonus awards associated with the player hands. In another embodiment, the player receives a bonus award if any of the player or dealer hands is of a predetermined rank. In this embodiment, even if the player ultimately loses the main game, there is still a chance to win a bonus award if one of the dealer hands has a sufficiently high rank. For example, if the player loses to the dealer and the high three-card dealer hand is a Royal Straight Flush, the player would win a bonus award despite the loss in the main game.

In one embodiment, the player can place a bonus wager on a side game, where the side game pays an award if five of the total seven player cards form a sufficiently high rank. For example, if the player placed the side wager and if the seven player cards include 3♦A♣ 10♣ 6♥ K♣ J♣ Q♣ then the player wins a bonus award based on the five cards that form the Royal Straight Flush (i.e., the A♣K♣Q♣J♣10♣). It should also be appreciated that, in an embodiment, this bonus award may also be provided if the cards in the dealer hand form a sufficiently high rank.

In one embodiment, the deck of cards includes one or more Jokers. The Joker functions as a wild card. In one such embodiment, if the Joker occurs in the player hand, the Joker substitutes as a Ace of any suit. However, if the Joker occurs in the dealer hand, the Joker substitutes for any rank of any suit. For example, if the player has a three-card hand that include A♥A♦ and the Joker, the player would have a Three-Of-A-Kind of Aces. In another example if the dealer has a three-card hand that includes 5♠6♠ and the Joker, the dealer would have a Straight Flush. However in this example, the player would only have a flush, where the Joker substitutes for an Ace of spades.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

at least one input device;

at least one processor;

at least one display device; and at least one memory device storing a plurality of instructions which when executed by the at least one processor, cause the at least one processor to operate with the at least one display device and the at least one input device to, for a play of a game:

(a) enable a wager to be placed, (b) deal at least six dealer cards and deal at least six player cards, (c) receive at least one input to form a first player hand, a second player hand, and a third player hand, a rank of the second player hand not being greater than a rank of the first player hand and a rank of the third player hand not being greater than the rank of the second player hand, (d) reveal the dealer cards and form a first dealer hand, a second dealer hand, and a third dealer hand, a rank of the second dealer hand not being greater than a rank of the first dealer hand and a rank of the third dealer hand not being greater than the rank of the second dealer hand, (e) determine if the first player hand beats the first dealer hand, (f) determine if the second player hand beats the second dealer hand, (g) determine if the third player hand beats the third dealer hand, and (h) if a majority of the player hands beat the corresponding dealer hands, display an award.

2. The gaming system of claim 1, wherein the number of player cards is six, and wherein the number of dealer cards is six.

3. The gaming system of claim 2, wherein each of the first player hand, the second player hand, the first dealer hand, and the second dealer hand include three cards.

4. The gaming system of claim 2, wherein if one of the player hands beats the corresponding dealer hand, and the other two of the player hands does not beat the corresponding dealer hands, the at least one processor operates with the at least one display device and the at least one input device to:

determine a best ranking five-card player hand from the six total player cards;

determine a best ranking five-card dealer hand from the six total dealer cards; and display an award if the five-card player hand beats the five-card dealer hand.

5. The gaming system of claim 1, wherein the number of player cards is seven and the number of dealer cards is seven.

6. The gaming system of claim 5, wherein the at least one processor operates with the at least one display device and the at least one input device to:

receive at least one input to form the first player hand including three of the player cards, the second player hand including three of the player cards, and the third player hand including one of the player cards, the rank of the second player hand not being greater than the rank of the first player hand, and the rank of the third player hand not being greater the rank of the second player hand;

reveal dealer cards and form the first dealer hand including three of the dealer cards, the second dealer hand including three of the dealer cards, and the third dealer hand including one of the dealer cards, the rank of the second dealer hand not being greater than the rank of the first dealer hand, and the rank of the third dealer hand not being greater than the rank of the second dealer hand; and determine if the third player hand beats the third dealer hand.

7. The gaming system of claim 6, wherein the first dealer hand, the second dealer hand, and the third dealer hand are formed based on the value of at least one of the player cards.

8. The gaming system of claim 1, wherein the at least one processor operates with the at least one display device and the at least one input device to determine a highest ranking five-card player hand from the at least six player cards in the first, second, and third player hands, and display an award according to a paytable based on a rank of the highest ranking five-card player hand.

9. A gaming system comprising:

at least one input device;

at least one processor;

at least one display device; and at least one memory device storing a plurality of instructions which when executed by the at least one processor, cause the at least one processor to operate with the at least one display device and the at least one input device to, for a play of a game:

(a) enable a wager to be placed, (b) deal at least seven dealer cards and at least seven player cards, (c) form at least a first three-card dealer hand, a second three-card dealer hand, and a single-card dealer hand, a rank of the second dealer hand not being greater than a rank of the first dealer hand and a rank of the single-card dealer hand not being greater than the rank of the second dealer hand, (d) receive at least one input to form at least a first three-card player hand, a second three-card player hand, and a single-card player hand, a rank of the second player hand not being greater than a rank of the first player hand and a rank of the single-card player hand not being greater than the rank of the second player hand, (e) determine if the first player hand beats the first dealer hand, (f) determine if the second player hand beats the second dealer hand, and (g) if the first player hand beats the first dealer hand and the second player hand beats the second dealer hand, display an award.

10. The gaming system of claim 9, wherein if only one of the first player hand and the second player hand beats the respective dealer hand, the at least one processor operates with the at least one display device and the at least one input device to initiate a tie-breaking event.

11. The gaming system of claim 10, wherein the tie-breaking event includes determining if the single-card player hand is higher than the single-card dealer hand.

12. The gaming system of claim 10, wherein the tie-breaking event includes determining a highest ranking five-card player hand from the at least seven player cards, determining a highest ranking five-card dealer hand from the at least seven dealer cards, and determining if the five-card player hand beats the five-card dealer hand.

13. The gaming system of claim 11, wherein the tie-breaking event includes:

dealing a total of seven player cards and seven dealer cards;

determining a highest ranking five-card player hand from the seven player cards;

determining a highest ranking five-card dealer hand from the at least six dealer cards; and determining if the five-card player hand beats the five-card dealer hand.

14. The gaming system of claim 10, wherein if only one of the first player hand and the second player hand beats the respective dealer hand, the at least one processor operates with the at least one display device and the at least one input device to refund the wager.

15. A gaming system comprising:

at least one input device;

at least one processor;

at least one display device; and at least one memory device storing a plurality of instructions which when executed by the at least one processor, cause the at least one processor to operate with the at least one display device and the at least one input device to, for a play of a game:

(a) enable an Ante wager to be placed, (b) deal seven player cards face-up and seven dealer cards face-down, (c) enable a Play wager to be placed, (d) if the Play wager is not placed, terminate the play of the game, and (e) if the Play wager was placed:

(i) receive at least one input to form a first player hand, a second player hand, and a third player hand from the player cards, a rank of the second player hand not being greater than a rank of the first player hand, and the rank of the third player hand not being greater than a rank of the second player hand, (ii) reveal dealer cards and form a first dealer hand, a second dealer hand, and a third dealer hand from the dealer cards, a rank of the second dealer hand not being greater than a rank of the first dealer hand, and a rank of the third dealer hand not being greater or equal to a rank of the second dealer hand, (iii) if the rank of the first dealer hand and the second dealer hand are both less than a dealer qualifying rank, refund the Ante wager and Play wager, provide an award based on the Ante wager, and terminate the play of the game, (iv) determine if the first player hand beats the first dealer hand, (v) determine if the second player hand beats the second dealer hand, (vi) determine if the third player hand beats the third dealer hand, and (vii) if a majority of the player hands beat the corresponding dealer hands, display an award based on the Ante wager and the Play wager, and refund the Ante wager and Play wager.

16. The gaming system of claim 15, wherein the at least one processor operates with the at least one display device and the at least one input device to determine a highest ranking five-card player hand from the seven player cards, and display an award according to a paytable based on the Ante wager and a rank of the highest ranking five-card player hand.

17. The gaming system of claim 15, wherein the at least one processor operates with the at least one display device and the at least one input device to display an award according to a paytable based on a rank of the first player hand.

18. The gaming system of claim 15, wherein the at least one processor operates with the at least one display device and the at least one input device to display an award according to a paytable based on a rank of either of the first player hand or the first dealer hand.

19. The gaming system of claim 15, wherein the at least one processor operates with the at least one display device and the at least one input device to display an award according to a paytable based on a rank of the first player hand and a rank of the second player hand.

20. The gaming system of claim 15, wherein the at least one processor operates with the at least one display device and the at least one input device to display an award according to a paytable based on a rank of at least four of the seven player cards.

21. A method of operating a gaming system to provide a play of a card game, the method comprising:

causing at least one processor to operate with at least one display device and at least one input device to:

(a) enable a wager to be placed;

(b) deal at least seven dealer cards and deal at least seven player cards;

(c) form a first three-card player hand, a second three-card player hand, and a single-card player hand, a rank of the second three-card player hand not being greater than a rank of the first three-card player hand and a rank of the single-card player hand not being greater than the rank of the second three-card player hand;

(d) reveal the dealer cards and form a first three-card dealer hand, a second three-card dealer hand, and a single-card dealer hand, a rank of the second three-card dealer hand not being greater than a rank of the first three-card dealer hand and a rank of the single-card dealer hand not being greater than the rank of the second three-card dealer hand;

(e) determine if the first three-card player hand beats the first three-card dealer hand;

(f) determine if the second three-card player hand beats the second three-card dealer hand; and (g) determine if the single-card player hand beats the single-card dealer hand; and causing the at least one processor to operate with the at least one display device to:

(h) display an award if a majority of the player hands beat the corresponding dealer hands.

22. The method of claim 21, wherein the award is a first amount if the first and second three-card player hands beat the corresponding dealer hands and the award is a second amount if either of the first and second three-card player hands and the single-card player hand beat the corresponding dealer hands.

23. The method of claim 22, wherein the first amount is greater than the second amount.

24. A method of operating a gaming system to provide a play of a card game, the method comprising:

causing at least one processor to operate with at least one display device and at least one input device to:

(a) enable a wager to be placed, (b) deal at least six dealer cards and deal at least six player cards, (c) receive at least one input to form a first player hand, a second player hand, and a third player hand, a rank of the second player hand not being greater than a rank of the first player hand and a rank of the third player hand not being greater than the rank of the second player hand, (d) reveal the dealer cards and form a first dealer hand, a second dealer hand, and a third dealer hand, a rank of the second dealer hand not being greater than a rank of the first dealer hand and a rank of the third dealer hand not being greater than the rank of the second dealer hand, (e) determine if the first player hand beats the first dealer hand, (f) determine if the second player hand beats the second dealer hand, and (g) determine if the third player hand beats the third dealer hand, and causing the at least one processor to operate with the at least one display device to:

(h) if a majority of the player hands beat the corresponding dealer hands, display an award.

25. A method of operating a gaming system to provide a play of a card game, the method comprising:

causing at least one processor to operate with at least one display device and at least one input device to:

(a) enable an Ante wager to be placed, (b) deal seven player cards face-up and seven dealer cards face-down, (c) enable a Play wager to be placed, (d) if the Play wager is not placed, terminate the play of the game, and (e) if the Play wager was placed:

(i) receive at least one input to form a first player hand, a second player hand, and a third player hand from the player cards, a rank of the second player hand not being greater than a rank of the first player hand, and the rank of the third player hand not being greater than a rank of the second player hand, (ii) reveal dealer cards and form a first dealer hand, a second dealer hand, and a third dealer hand from the dealer cards, a rank of the second dealer hand not being greater than a rank of the first dealer hand, and a rank of the third dealer hand not being greater or equal to a rank of the second dealer hand, (iii) if the rank of the first dealer hand and the second dealer hand are both less than a dealer qualifying rank, refund the Ante wager and Play wager, provide an award based on the Ante wager, and terminate the play of the game, (iv) determine if the first player hand beats the first dealer hand, (v) determine if the second player hand beats the second dealer hand, and (vi) determine if the third player hand beats the third dealer hand, and causing the at least one processor to operate with the at least one display device to:

(vii) if a majority of the player hands beat the corresponding dealer hands, display an award based on the Ante wager and the Play wager, and refund the Ante wager and Play wager.

* * * * *

UNITED STATES PATENT AND TRADEMARK OFFICE

CERTIFICATE OF CORRECTION

PATENT NO. : 8,177,616 B2
APPLICATION NO. : 11/935847
DATED : May 15, 2012
INVENTOR(S) : Mark C. Nicely It is certified that error appears in the above-identified patent and that said Letters Patent is hereby corrected as shown below:

IN THE CLAIMS

In Claim 2, Column 39, Line 65, replace the second instance of "the" with --a-- and after the second instance of "of" insert --the--.
In Claim 2, Column 29, Line 66, replace "the" with --a-- and between "of" and "dealer" insert --the--.
In Claim 3, Column 40, Line 3, replace "include" with --includes--.
In Claim 4, Column 40, Line 6, replace "does" with --do--.
In Claim 4, Column 40, Line 13, between "the" and "five-card" insert --best ranking--.
In Claim 4, Column 40, Lines 13 to 14, between "the" and "five-card" insert --best ranking--.
In Claim 5, Column 40, Line 15, replace the second instance of "the" with --a-- and after the second instance of "of" insert --the--.
In Claim 5, Column 40, Line 16, replace "the" with --a-- and between "of" and "dealer" insert --the--.
In Claim 6, Column 40, Line 20, between "receive" and "at" insert --the--.
In Claim 6, Column 40, Line 27, between "reveal" and "dealer" insert --the--.
In Claim 7, Column 40, Line 39, replace the first instance of "the" with --a--.
In Claim 12, Column 41, Line 24, between "the" and "five-card" insert --highest ranking--.
In Claim 12, Column 41, Line 25, between "the" and "five-card" insert --highest ranking--.
In Claim 13, Column 41, Line 32, replace "at least six" with --seven--.
In Claim 13, Column 41, Line 33, between both instances of "the" and "five-card" insert --highest ranking--.
In Claim 15, Column 41, Line 60, replace the first instance of "the" with --a--.
In Claim 15, Column 41, Line 61, replace "a" with --the--.
In Claim 15, Column 41, Line 62, between "reveal" and "dealer" insert --the--.
In Claim 15, Column 41, Line 67, replace "a" with --the--.
In Claim 17, Column 42, Line 25, replace "an" with --the--.
In Claim 17, Column 42, Line 26, replace "a" with --the--.
In Claim 18, Column 42, Line 29, replace "an" with --the--.
In Claim 18, Column 42, Line 30, replace "a" with --the--.
In Claim 19, Column 42, Line 34, replace "an" with --the--.

Signed and Sealed this
Eighth Day of January, 2013

David J. Kappos

David J. Kappos
*Director of the United States Patent and Trademark Office*

IN THE CLAIMS

In Claim 19, Column 42, Line 35, replace both instances of “a” with --the--.
In Claim 20, Column 42, Line 39, replace “an” with --the--.
In Claim 25, Column 44, Line 14, replace the first instance of “the” with --a--.
In Claim 25, Column 44, Line 15, replace “a” with --the--.
In Claim 25, Column 44, Line 16, between “reveal” and “dealer” insert --the--.
In Claim 25, Column 44, Line 21, replace “a” with --the--.